US011855363B2

(12) United States Patent
Sampo

(10) Patent No.: US 11,855,363 B2
(45) Date of Patent: Dec. 26, 2023

(54) ANTENNA DEVICE

(71) Applicant: YOKOWO CO., LTD., Tokyo (JP)

(72) Inventor: Takeshi Sampo, Tomioka (JP)

(73) Assignee: YOKOWO CO., LTD., Tokyo (JP)

( * ) Notice: Subject to any disclaimer, the term of this patent is extended or adjusted under 35 U.S.C. 154(b) by 0 days.

(21) Appl. No.: 17/628,902

(22) PCT Filed: May 7, 2020

(86) PCT No.: PCT/JP2020/018514
§ 371 (c)(1),
(2) Date: Jan. 21, 2022

(87) PCT Pub. No.: WO2021/019863
PCT Pub. Date: Feb. 4, 2021

(65) Prior Publication Data

US 2022/0263242 A1 Aug. 18, 2022

(30) Foreign Application Priority Data

Jul. 26, 2019 (JP) ..... 2019-137639

(51) Int. Cl.
*H01Q 5/40* (2015.01)
*H01Q 23/00* (2006.01)
(Continued)

(52) U.S. Cl.
CPC ..... *H01Q 5/40* (2015.01); *H01Q 5/10* (2015.01); *H01Q 13/08* (2013.01); *H01Q 21/24* (2013.01); *H01Q 23/00* (2013.01)

(58) Field of Classification Search
CPC .... H01Q 13/106; H01Q 21/065; H01Q 5/378; H01Q 9/0414; H01Q 5/40; H01Q 5/10;
(Continued)

(56) References Cited

U.S. PATENT DOCUMENTS 6,809,686 B2 10/2004 Du et al.
7,277,056 B1 10/2007 Thiam et al.
(Continued)

FOREIGN PATENT DOCUMENTS

EP 3460904 A1 3/2019
JP 7-336133 A 12/1995
(Continued)

OTHER PUBLICATIONS

International Search Report and Written Opinion dated Jul. 21, 2020, received for PCT Application PCT/JP2020/018514, Filed on May 7, 2020, 9 pages including English Translation.
(Continued)

*Primary Examiner* — Vibol Tan
(74) *Attorney, Agent, or Firm* — XSENSUS LLP

(57) ABSTRACT

A first conductive plate (110) is located at a first surface (302) side of a substrate (300) away from the first surface (302) of the substrate (300). The first conductive plate (110) has an opening (112). A first conductive part (120) electrically connects the first conductive plate (110) and the substrate (300) to each other. A second conductive plate (210) is located at the first surface (302) side of the substrate (300) away from the first surface (302) of the substrate (300). A second conductive part (220) electrically connects the second conductive plate (210) and the substrate (300) to each other. The second conductive plate (210) is located inside the opening (112) of the first conductive plate (110).

15 Claims, 17 Drawing Sheets

(51) Int. Cl.
*H01Q 5/10* (2015.01)
*H01Q 13/08* (2006.01)
*H01Q 21/24* (2006.01)

(58) Field of Classification Search
CPC ..... H01Q 13/08; H01Q 21/24; H01Q 23/00; H01Q 5/50; H01Q 9/0435; H01Q 9/0464
See application file for complete search history.

(56) References Cited

U.S. PATENT DOCUMENTS

| | | | | |
|---|---|---|---|---|
| 7,518,567 | B2 * | 4/2009 | Utagawa | H01Q 1/243 343/846 |
| 9,692,127 | B2 * | 6/2017 | Yamagajo | H01Q 5/40 |
| 9,799,958 | B2 * | 10/2017 | Sampo | H01Q 9/0435 |
| 11,456,534 | B2 * | 9/2022 | Mitchell | H01Q 5/378 |
| 2011/0254740 | A1 | 10/2011 | Maeda et al. | |
| 2021/0119337 | A1 | 4/2021 | Namba | |
| 2021/0135363 | A1 | 5/2021 | Sone | |

FOREIGN PATENT DOCUMENTS

| | | | |
|---|---|---|---|
| JP | H08-008638 | A | 1/1996 |
| JP | 2012-54917 | A | 3/2012 |
| JP | 2014-022925 | A | 2/2014 |
| JP | 2018-191111 | A | 11/2018 |
| WO | 2018/159668 | A1 | 9/2018 |

OTHER PUBLICATIONS

Office Action dated Jul. 4, 2023 in Japanese Patent Application No. 2019-1376359, 2 pages.

Office Action dated Apr. 18, 2023 in Japanese Patent Application No. 2019-137639, 5 pages.

Office Action dated Jul. 12, 2023 in corresponding European Patent Application No. 20847416.3, citing above-listed references, 9 pages.

* cited by examiner

ANTENNA DEVICE

CROSS-REFERENCE TO RELATED APPLICATIONS

The present application is based on PCT filing PCT/JP2020/018514, filed May 7, 2020, which claims priority to JP 2019-137639, filed Jul. 26, 2019, the entire contents of each are incorporated herein by reference.

TECHNICAL FIELD

The present invention relates to an antenna device.

BACKGROUND ART

In recent years, an antenna device including a plurality of elements has been developed. For example, as described in Patent Document 1, an antenna device including stacked patch antennas has been developed. The antenna device of Patent Document 1 includes a substrate (for example, a printed circuit substrate (PCB)), a first patch antenna, and a second patch antenna. The first patch antenna is tuned fora first frequency band (for example, the Satellite Digital Audio Radio Service (SDARS) frequency band). The second patch antenna is tuned for the second frequency band (for example, the Global Positioning System (GPS) frequency band). The second patch antenna is located on the substrate. The first patch antenna is located on the second patch antenna.

RELATED DOCUMENT

Patent Document

[Patent Document 1] U.S. Pat. No. 7,277,056

SUMMARY OF THE INVENTION

Technical Problem

The present inventor has studied facilitating the manufacture of an antenna device including a plurality of elements. For example, in the antenna device of Patent Document 1, the characteristics (for example, resonance frequency) of the antenna device may fluctuate according to the variation in the dielectric materials of the first patch antenna and the second patch antenna. Therefore, in order to reduce fluctuations in the characteristics of the antenna device, a complicated process may be required for manufacturing the antenna device.

An example of an object of the present invention is to facilitate the manufacture of an antenna device. Other objects of the present invention will become apparent from the description herein.

Solution to Problem

One aspect of the present invention is an antenna device including:

a substrate including a first surface;

a first element including a first conductive plate and a first conductive part, the first conductive plate being located at the first surface side of the substrate away from the first surface of the substrate, the first conductive plate including an opening, the first conductive part electrically connecting the first conductive plate and the substrate to each other; and a second element including a second conductive plate and a second conductive part, the second conductive plate being located at the first surface side of the substrate away from the first surface of the substrate, the second conductive part electrically connecting the second conductive plate and the substrate to each other, in which the second conductive plate is located inside the opening of the first conductive plate.

Advantageous Effects of Invention

According to the above-described aspect of the present invention, the manufacture of the antenna device can be facilitated.

DESCRIPTION OF EMBODIMENTS

Figure 1:
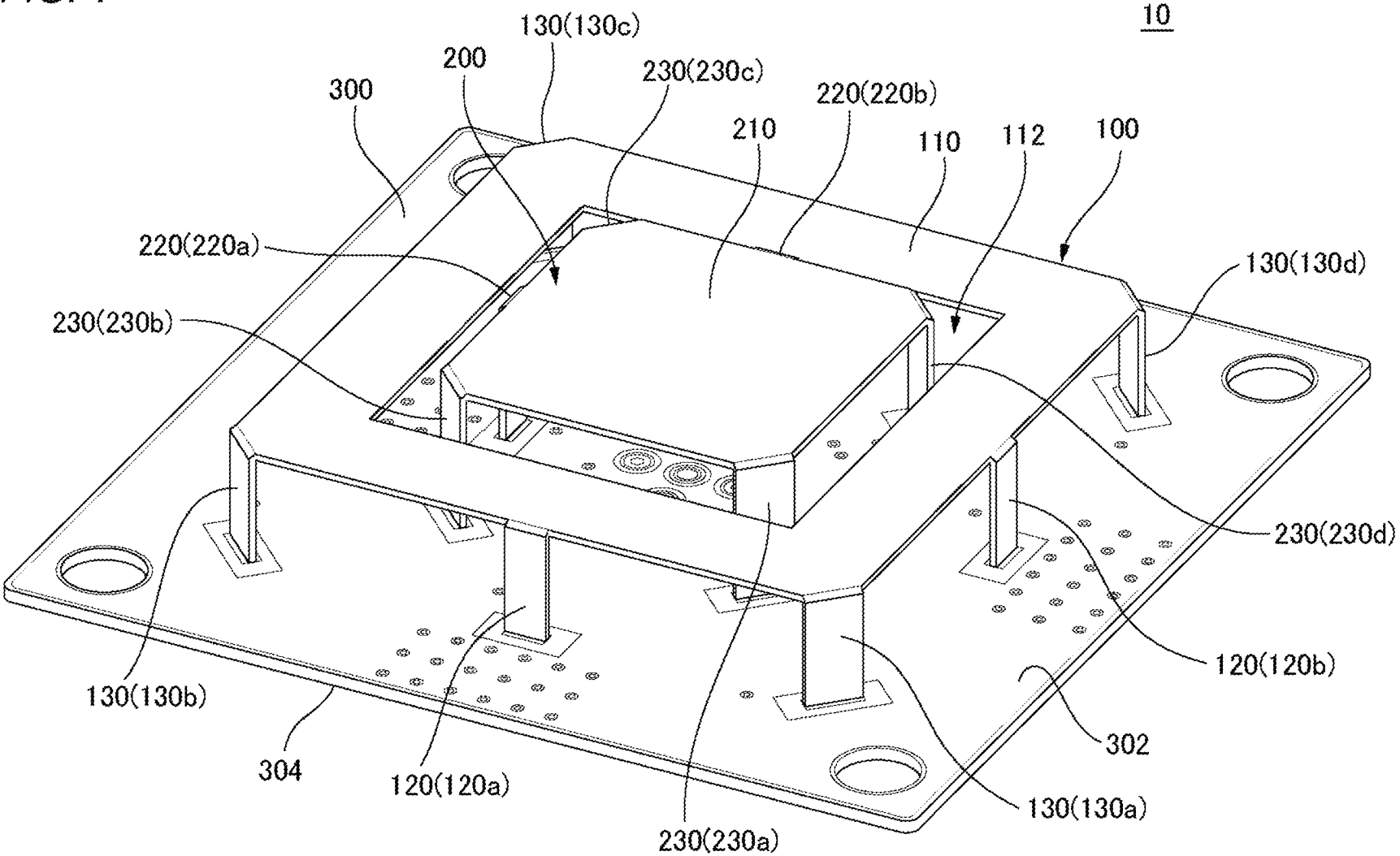
FIG. 1 is a perspective view of an antenna device according to an embodiment.

Hereinafter, an antenna device according to an embodiment of the present invention will be described with reference to the drawings. In all drawings, similar components are designated by the same reference numerals, and description thereof will not be repeated as appropriate. The antenna device according to the present embodiment described below can be used as, for example, a vehicular antenna device, and can also be used in various devices other than for vehicles, depending on the application.

In the present specification, the ordinal numbers such as "first", "second", and "third" are added only to distinguish the components having the same names unless otherwise specified, and does not mean a particular feature (for example, order or importance) of the component.

Figure 2:
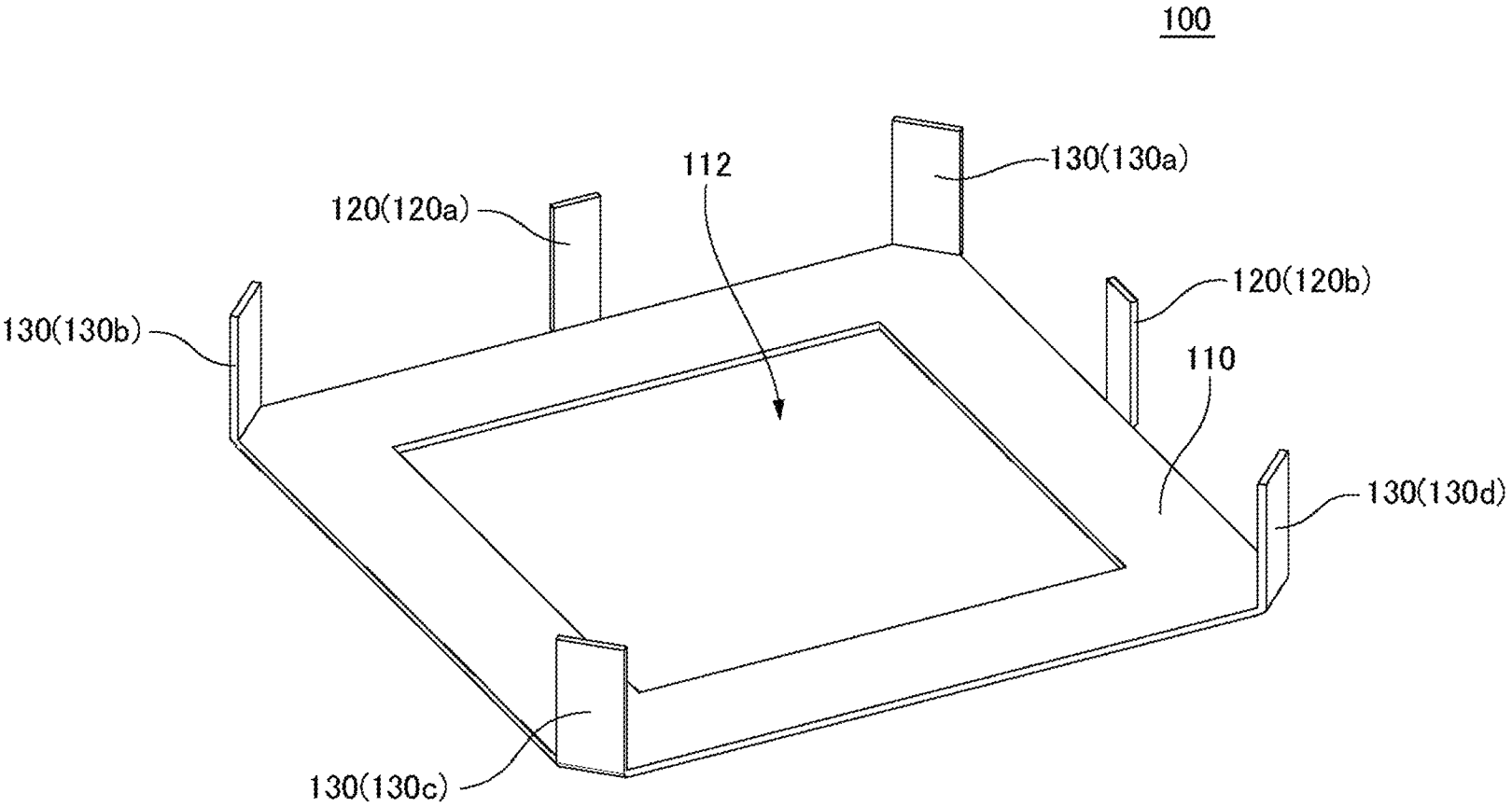
FIG. 2 is a perspective view of a first element shown in FIG. 1 from the opposite side of FIG. 1.
Figure 3:
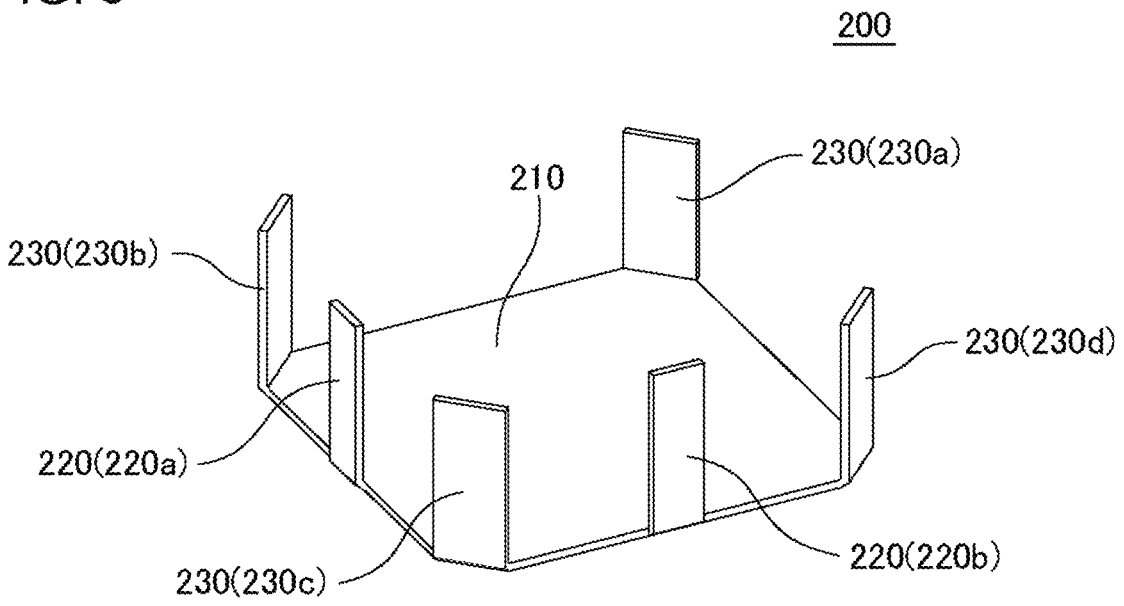
FIG. 3 is a perspective view of a second element shown in FIG. 1 from the opposite side of FIG. 1.

FIG. 1 is a perspective view of an antenna device 10 according to the embodiment. FIG. 2 is a perspective view of a first element 100 shown in FIG. 1 from the opposite side of FIG. 1. FIG. 3 is a perspective view of a second element 200 shown in FIG. 1 from the opposite side of FIG. 1.

The outline of the antenna device 10 will be described with reference to FIG. 1. The antenna device 10 includes a first element 100, a second element 200, and a substrate 300. The substrate 300 has a first surface 302 and a second surface 304. The second surface 304 is opposite to the first surface 302. The first element 100 has a first conductive plate 110, two first conductive parts 120, and four third conductive parts 130. The second element 200 has a second conductive plate 210, two second conductive parts 220, and four fourth conductive parts 230. The first conductive plate 110 is located on the first surface 302 (at the first surface 302 side) of the substrate 300 away from the first surface 302 of the substrate 300. The first conductive plate 110 faces the first surface 302. The first conductive plate 110 may be parallel or inclined as long as it faces the first surface 302. Further, the first conductive plate 110 has an opening 112. Each of the first conductive parts 120 is connected to the first conductive plate 110, and electrically connects the first conductive plate 110 and the substrate 300 to each other. Each of the third conductive parts 130 is connected to the first conductive plate 110 and inserted into the substrate 300. The second conductive plate 210 is located on the first surface 302 (at the first surface 302 side) of the substrate 300 away from the first surface 302 of the substrate 300. The second conductive plate 210 faces the first surface 302. The second conductive plate 210 may be parallel or inclined as long as it faces the first surface 302. The second conductive plate 210 is located inside the opening 112 of the first conductive plate 110 when viewed from the direction perpendicular to the first surface 302 of the substrate 300. Each of the second conductive parts 220 is connected to the second conductive plate 210, and electrically connects the second conductive plate 210 and the substrate 300 to each other. Each of the fourth conductive parts 230 is connected to the second conductive plate 210 and inserted into the substrate 300.

According to the present embodiment, the characteristics (for example, resonance frequency) of the first element 100 can be adjusted by a simple method such as, for example, adjusting the shape of the first conductive plate 110, and adjusting the distance between the first conductive plate 110 and the substrate 300. Similarly, the characteristics of the second element 200 can be adjusted by a simple method. Therefore, the manufacture of the antenna device 10 can be facilitated.

The details of the antenna device 10 will be described with reference to FIGS. 1 to 3.

In the present embodiment, the first element 100 and the second element 200 have different resonance frequencies from each other. For example, the resonance frequency of the second element 200 is higher than the resonance frequency of the first element 100. However, the resonance frequency of the second element 200 may be lower than or the same as the resonance frequency of the first element 100. More specifically, in the present embodiment, the first element 100 functions as a Global Navigation Satellite System (GNSS) band antenna (for example, a Global Positioning Satellite (GPS) band antenna), and the second element 200 functions as a Sirius XM (SXM) band antenna. However, as is clear from the description of the present specification, the same configuration as that of the present embodiment can be applied to an antenna different from the above-described antenna.

In the present embodiment, the distance from the first surface 302 of the substrate 300 to the second conductive plate 210 of the second element 200 is equal to or greater than the distance from the first surface 302 of the substrate 300 to the first conductive plate 110 of the first element 100. Specifically, in the direction perpendicular to the first surface 302 of the substrate 300, the shortest distance from the first surface 302 of the substrate 300 to the second conductive plate 210 of the second element 200 is equal to or greater than the shortest distance from the first surface 302 of the substrate 300 to the first conductive plate 110 of the first element 100. In this case, as will be described later, the gain of the second element 200 can be improved. However, in the direction perpendicular to the first surface 302 of the substrate 300, the shortest distance from the first surface 302 of the substrate 300 to the second conductive plate 210 of the second element 200 may be shorter than the shortest distance from the first surface 302 of the substrate 300 to the first conductive plate 110 of the first element 100.

The first element 100 is made of a sheet metal. Specifically, the first conductive plate 110, the first conductive part 120, and the third conductive part 130 are integrated. In other words, the first conductive part 120 and the third conductive part 130 are physically coupled to the first conductive plate 110. Further, the portion of the first element 100 from the first conductive plate 110 to the first conductive part 120 and the third conductive part 130 is bent from the direction along the first surface 302 of the substrate 300 to the direction toward the first surface 302 of the substrate 300. The first element 100 is formed by bending a sheet metal. Therefore, the first element 100 can be easily manufactured, as compared with the case where the first conductive part 120 and the third conductive part 130 are attached to the first conductive plate 110 by welding. However, the manufacturing method of the first element 100 is not limited to this example. For example, at least one of the first conductive part 120 or the third conductive part 130 may be integrated with the first conductive plate 110, by attaching the first conductive part 120 and the third conductive part 130 to the first conductive plate 110 by welding, for example, instead of bending the sheet metal.

The first conductive plate 110 has an inner edge defining the opening 112, and an outer edge located outside the inner edge. The inner edge of the first conductive plate 110 is a quadrangular region (opening 112). However, the shape of the inner edge of the first conductive plate 110 is not limited to the above-described quadrangular shape, and may be, for example, a circular shape or a polygonal shape. The outer edge of the first conductive plate 110 is a rectangular region (this quadrangle may not be a strict quadrangle. The third conductive part 130 is bent in the direction from the first conductive plate 110 toward the first surface 302 of the substrate 300, so that the shape is such that the four corners of the quadrangle are cut off. That is, strictly speaking, the shape of the outer edge of the first conductive plate 110 is octagonal.). The outer edge of the first conductive plate 110 does not have a section recessed toward the inside of the first conductive plate 110 or a protrusion protruding toward the outside of the first conductive plate 110. That is, each side of the outer edge of the first conductive plate 110 is linear. Therefore, as compared with the case where the outer edge of the first conductive plate 110 has a section recessed toward the inside of the first conductive plate 110 or a protrusion protruding toward the outside of the first conductive plate 110, the first element 100 can be easily bent, and the first element 100 can be easily molded. Further, as compared with the case where the outer edge of the first conductive plate 110 has a section recessed toward the inside of the first conductive plate 110 or a protrusion protruding toward the outside of the first conductive plate 110, it is easy to adjust the length (including the electrical length) of each side of the outer edge of the first conductive plate 110, and to design the first element 100. However, the shape of the outer edge of the first conductive plate 110 is not limited to the above shape, and may be, for example, a circle. Further, the outer edge of the first conductive plate 110 may have the above-described section or protrusion.

The four third conductive parts 130 (third conductive part 130*a*, third conductive part 130*b*, third conductive part 130*c*, and third conductive part 130*d*) are located around the center of the first conductive plate 110 at intervals of 90°. Therefore, as compared with the case where less than four (for example, two) third conductive parts 130 are provided, the first element 100 can be stably supported on the substrate 300 by the four third conductive parts 130. Each of the third conductive parts 130 is fixed to the substrate 300 by, for example, solder (not shown in the drawings). In the present embodiment, the four third conductive parts 130 are connected to the outer edge of the first conductive plate 110. More specifically, the four third conductive parts 130 are connected to the four corners of the outer edge of the first conductive plate 110. In this way, each of the third conductive parts 130 is electrically connected to the outer edge of the first conductive plate 110. However, the number and arrangement of the third conductive parts 130 are not limited to the examples shown in FIGS. 1 and 2.

The two first conductive parts 120 (the first conductive part 120*a* and the first conductive part 120*b*) are located around the center of the first conductive plate 110 at intervals of 90°. Two feeding points are formed by the two first conductive parts 120. Therefore, the first element 100 can transmit and receive circularly polarized radio waves. By using not only the third conductive parts 130 but also the first conductive parts 120, the first element 100 can be more stably supported on the substrate 300. Each of the first conductive parts 120 is fixed to the substrate 300 by, for example, solder (not shown in the drawings). In the present embodiment, the two first conductive parts 120 are connected to the outer edge of the first conductive plate 110. More specifically, the first conductive part 120*a* is connected to the central portion between the third conductive part 130*a* and the third conductive part 130*b* of the outer edge of the first conductive plate 110. The first conductive part 120*b* is connected to the central portion between the third conductive part 130*a* and the third conductive part 130*d* of the outer edge of the first conductive plate 110. In this way, each of the first conductive parts 120 is electrically connected to the outer edge of the first conductive plate 110. In the present embodiment, the first element 100 can be formed by bending the first conductive part 120 located on the outer edge of the first conductive plate 110 in the direction toward the first surface 302 of the substrate 300. Therefore, as compared with the case where the first conductive part 120 is connected to the inner edge of the first conductive plate 110, the first element 100 can be easily bent, and the first element 100 can be easily manufactured. However, the number and arrangement of the first conductive parts 120 are not limited to the examples shown in FIGS. 1 and 2. For example, the first conductive part 120 may be connected to the inner edge of the first conductive plate 110. Further, the number of the first conductive parts 120 may be only one such that only one feeding point is formed, or three or more such that three or more feeding points are formed. Further, even if the number of the first conductive parts 120 is plural, the number of feeding points may be smaller than the number of the first conductive parts 120. In this case, the first conductive part 120 in which the feeding point is not formed functions as a support portion of the first element 100.

The second element 200 is made of a sheet metal. Specifically, the second conductive plate 210, the second conductive part 220, and the fourth conductive part 230 are integrated. In other words, the second conductive part 220 and the fourth conductive part 230 are physically coupled to the second conductive plate 210. Further, the portion of the second element 200 from the second conductive plate 210 to the second conductive part 220 and the fourth conductive part 230 is bent from the direction along the first surface 302 of the substrate 300 to the direction toward the first surface 302 of the substrate 300. The second element 200 is formed by bending a sheet metal. Therefore, the second element 200 can be easily manufactured, as compared with the case where the second conductive part 220 and the fourth conductive part 230 are attached to the second conductive plate 210 by welding. However, the manufacturing method of the second element 200 is not limited to this example. For example, at least one of the second conductive part 220 and the fourth conductive part 230 may be integrated with the second conductive plate 210, by attaching the second conductive part 220 or the fourth conductive part 230 to the second conductive plate 210 by welding, for example, instead of bending the sheet metal.

The second conductive plate 210 has a quadrangular shape (This quadrangle may not be a strict quadrangle. The fourth conductive part 230 is bent in the direction from the second conductive plate 210 toward the first surface 302 of the substrate 300, so that the shape is such that the four corners of the quadrangle are cut off. That is, strictly speaking, the shape of the second conductive plate 210 is octagonal.). The outer edge of the second conductive plate 210 does not have a section recessed toward the inside of the second conductive plate 210 or a protrusion protruding toward the outside of the second conductive plate 210. That is, each side of the outer edge of the second conductive plate 210 is linear. Therefore, as compared with the case where the outer edge of the second conductive plate 210 has a section recessed toward the inside of the second conductive plate 210 or a protrusion protruding toward the outside of the second conductive plate 210, the second element 200 can be easily bent, and the second element 200 can be easily molded. Further, as compared with the case where the outer edge of the second conductive plate 210 has a section recessed toward the inside of the second conductive plate 210 or a protrusion protruding toward the outside of the second conductive plate 210, it is easy to adjust the length (including the electrical length) of each side of the outer edge of the second conductive plate 210, and to design the second element 200. However, the shape of the second conductive plate 210 is not limited to the above shape, and may be, for example, a circular shape or a polygonal shape. Further, the outer edge of the second conductive plate 210 may have the above-described section or protrusion.

The four fourth conductive parts 230 (fourth conductive part 230*a*, fourth conductive part 230*b*, fourth conductive part 230*c*, and fourth conductive part 230*d*) are located around the center of the second conductive plate 210 at intervals of 90°. Therefore, as compared with the case where less than four (for example, two) fourth conductive parts 230 are provided, the second element 200 can be stably supported on the substrate 300 by the four fourth conductive parts 230. Each of the fourth conductive parts 230 is fixed to the substrate 300 by, for example, solder (not shown in the drawings). In the present embodiment, the four fourth conductive parts 230 are connected to the outer edge of the second conductive plate 210. More specifically, the four fourth conductive parts 230 are connected to the four corners of the outer edge of the second conductive plate 210. In this way, each of the fourth conductive parts 230 is electrically connected to the outer edge of the second conductive plate 210. However, the number and arrangement of the fourth conductive parts 230 are not limited to the examples shown in FIGS. 1 and 3.

The two second conductive parts 220 (the second conductive part 220*a* and the second conductive part 220*b*) are located around the center of the second conductive plate 210 at intervals of 90°. Two feeding points are formed by the two second conductive parts 220. Therefore, the second element 200 can transmit and receive circularly polarized radio waves. By using not only the fourth conductive parts 230 but also the second conductive parts 220, the second element 200 can be more stably supported on the substrate 300. Each of the second conductive parts 220 is fixed to the substrate 300 by, for example, solder (not shown in the drawings). In the present embodiment, the two second conductive parts 220 are connected to the outer edge of the second conductive plate 210. More specifically, the second conductive part 220*a* is connected to the central portion between the fourth conductive part 230*b* and the fourth conductive part 230*c* of the outer edge of the second conductive plate 210. The second conductive part 220*b* is connected to the central portion between the fourth conductive part 230*c* and the fourth conductive part 230*d* of the outer edge of the second conductive plate 210. In this way, each of the second conductive parts 220 is electrically connected to the outer edge of the second conductive plate 210. However, the number and arrangement of the second conductive parts 220 are not limited to the examples shown in FIGS. 1 and 3. For example, the number of the second conductive parts 220 may be only one such that only one feeding point is formed, or three or more such that three or more feeding points are formed. Further, even if the number of the second conductive parts 220 is plural, the number of feeding points may be smaller than the number of the second conductive parts 220. In this case, the second conductive part 220 in which the feeding point is not formed functions as a support portion of the second element 200.

In the present embodiment, the third conductive part 130 (third conductive part 130*a*) located between the two first conductive parts 120 around the center of the first conductive plate 110 and the fourth conductive part 230 (fourth conductive part 230*c*) located between the two second conductive parts 220 around the center of the second conductive plate 210 are located opposite to each other across the center of the first conductive plate 110 or the second conductive plate 210. The two first conductive parts 120 and the two second conductive parts 220 are located symmetrically across the center of the first conductive plate 110 or the second conductive plate 210. Therefore, the two first conductive parts 120 of the first element 100 and the two second conductive parts 220 of the second element 200 can be spaced apart from each other at a sufficient distance. Therefore, isolation between the first element 100 and the second element 200 can be ensured. However, the layout of the first element 100 and the second element 200 is not limited to this example.

In the present embodiment, the antenna device 10 includes two elements (first element 100 and second element 200). However, the antenna device 10 may further include other elements. Other elements may be located outside the second element 200, for example, so as to surround the second element 200.

In the present embodiment, the first element 100 has a third conductive part 130. However, the first element 100 may not have the third conductive part 130. Even when the first element 100 does not have the third conductive part 130, the first conductive part 120 can support the first conductive plate 110 away from the first surface 302 of the substrate 300. Similarly, the second element 200 may not have the fourth conductive part 230.

In the present embodiment, the center of the first conductive plate 110 and the center of the second element 200 coincide with each other. However, the center of the first conductive plate 110 and the center of the second element 200 may be deviated from each other.

In the present embodiment, the first element 100 and the second element 200 do not have a conductive part for grounding to the substrate 300. Therefore, it is not necessary to form such a conductive part, and the first element 100 and the second element 200 can be easily manufactured. However, at least one of the first element 100 or the second element 200 may have a conductive part for grounding to the substrate 300.

In the present embodiment, the first conductive part 120 and the third conductive part 130 are physically directly connected to the first conductive plate 110. However, the first conductive part 120 and the third conductive part 130 may be physically spaced apart from the first conductive plate 110, and may be electrically connected to the first conductive plate 110 via a conductive member (for example, a copper wire). Similarly, in the present embodiment, the second conductive part 220 and the fourth conductive part 230 are physically directly connected to the second conductive plate 210. However, the second conductive part 220 and the fourth conductive part 230 may be physically spaced apart from the second conductive plate 210, and may be electrically connected to the second conductive plate 210 via a conductive member (for example, a copper wire).

In the present embodiment, the first conductive part 120 and the third conductive part 130 are conductive plates. However, the first conductive part 120 and the third conductive part 130 may be conductive wires such as copper wire, for example. The first conductive part 120 may be able to electrically connect the first conductive plate 110 and the substrate 300. Similarly, the second conductive part 220 and the fourth conductive part 230 are conductive plates. However, the second conductive part 220 and the fourth conductive part 230 may be conductive wires such as copper wire, for example. The second conductive part 220 may be able to electrically connect the second conductive plate 210 and the substrate 300.

In the present embodiment, all the members (the second conductive plate 210, the second conductive part 220, and the fourth conductive part 230) configuring the second element 200 are located inside the opening 112 of the first conductive plate 110. However, some members configuring the second element 200, such as the second conductive part 220 may be located other than inside the opening 112 of the first conductive plate 110 of the first element 100. As long as the second conductive plate 210 of the second element 200 is located inside the opening 112 of the first conductive plate 110 of the first element 100, various other configurations can be adopted.

Figure 4:
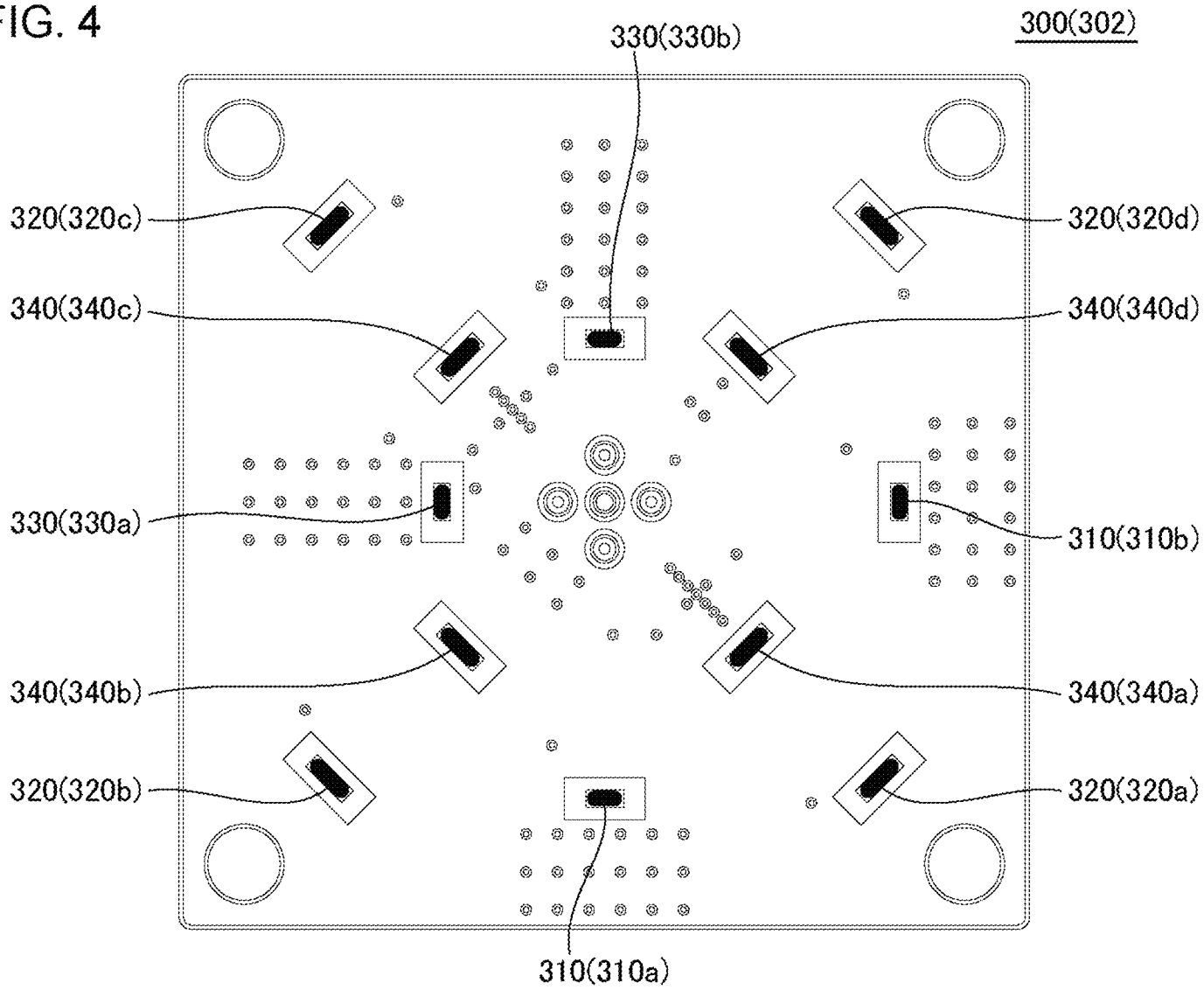
FIG. 4 is a plan view of a first surface of a substrate shown in FIG. 1.
Figure 5:
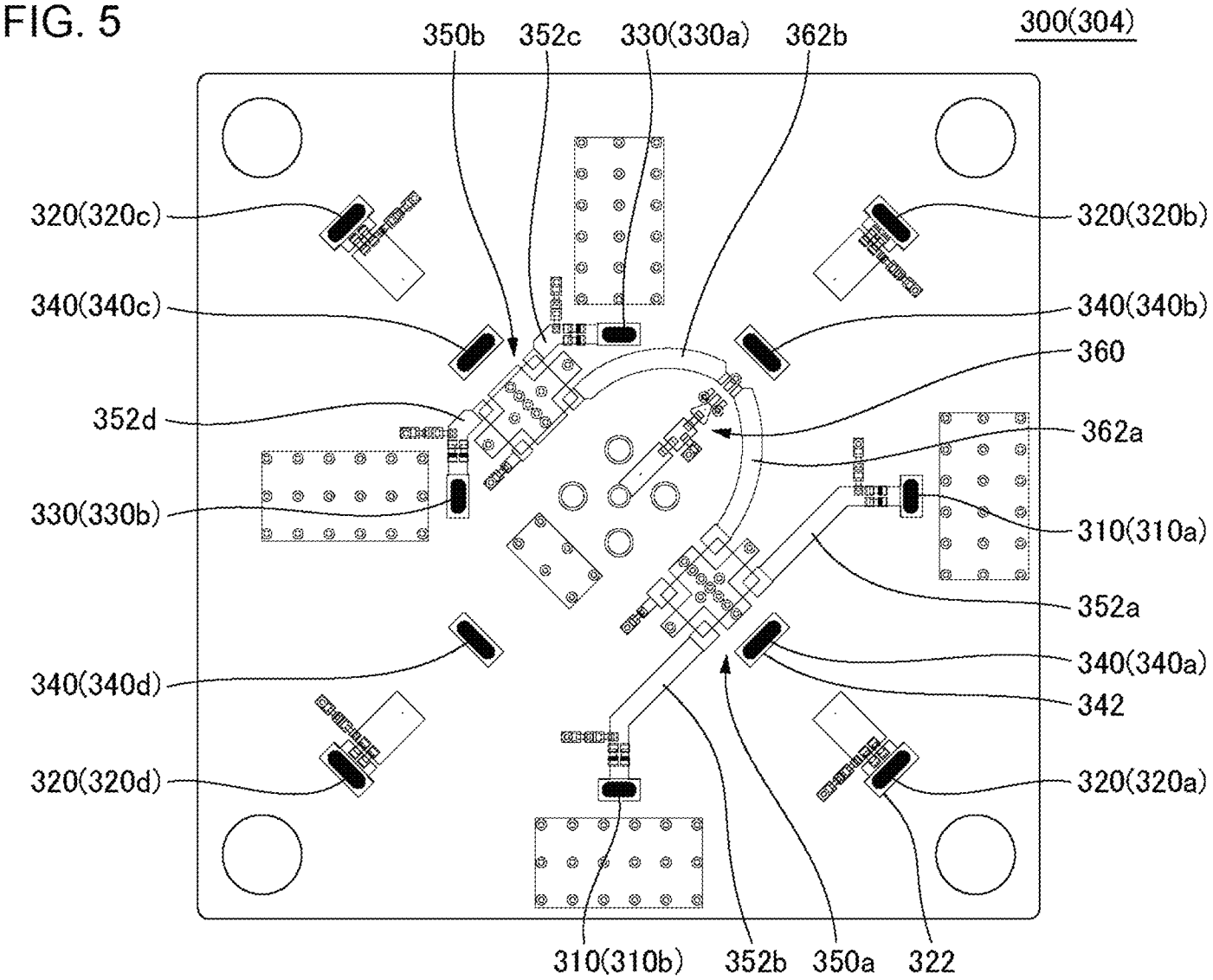
FIG. 5 is a plan view of a second surface of the substrate shown in FIG. 1.

FIG. 4 is a plan view of the first surface 302 of the substrate 300 shown in FIG. 1. FIG. 5 is a plan view of the second surface 304 of the substrate 300 shown in FIG. 1.

The details of the antenna device 10 will be described with reference to FIGS. 1 to 3 and FIGS. 4 and 5.

The substrate 300 is, for example, a printed circuit board (PCB). The substrate 300 has two first holes 310 (first hole 310*a* and first hole 310*b*) and four second holes 320 (second hole 320*a*, second hole 320*b*, second hole 320*c* and second hole 320*d*), two third holes 330 (third hole 330*a* and third hole 330*b*), and four fourth holes 340 (fourth hole 340*a*, fourth hole 340*b*, fourth hole 340*c*, and fourth hole 340*d*). The substrate 300 further includes a first hybrid circuit 350*a*, a second hybrid circuit 350*b*, and a diplexer 360. The substrate 300 further includes wiring 352*a*, wiring 352*b*, wiring 352*c*, wiring 352*d*, wiring 362*a*, and wiring 362*b*. In one example, without the first hole 310, the second hole 320, the third hole 330, the fourth hole 340, and the surrounding region thereof in the substrate 300, a region of the substrate 300 overlapping the first conductive plate 110 of the first element 100 and a region of the substrate 300 overlapping the second conductive plate 210 of the second element 200 may have a conductive pattern to which a fixed potential (for example, a ground potential) is applied.

The different first conductive parts 120 are inserted into the two respective first holes 310. That is, the first conductive part 120*a* and the first conductive part 120*b* are inserted into the first hole 310*a* and the first hole 310*b*, respectively. The first conductive part 120*a* inserted into the first hole 310*a* is electrically connected to the first hybrid circuit 350*a* via the wiring 352*a*. The first conductive part 120*b* inserted into the first hole 310*b* is electrically connected to the first hybrid circuit 350*a* via the wiring 352*b*. The first hybrid circuit 350*a* is electrically connected to the diplexer 360 via the wiring 362*a*.

The different third conductive parts 130 are inserted into the four respective second holes 320. That is, the third conductive part 130*a*, the third conductive part 130*b*, the third conductive part 130*c*, and the third conductive part 130*d* are inserted into the second hole 320*a*, the second hole 320*b*, the second hole 320*c*, and the second hole 320*d*, respectively. At the second surface 304 side of the substrate 300, each of the second holes 320 is surrounded by a first fixed pattern 322. It should be noted that a part of each of the second holes 320 may not be surrounded by the first fixed pattern 322. The first fixed pattern 322 is provided to fix the third conductive part 130 to the substrate 300. The third conductive part 130 is fixed to the substrate 300 by, for example, soldering the portion of the third conductive part 130 inserted into the substrate 300 and the first fixed pattern 322. The first fixed pattern 322 surrounds the portion of the third conductive part 130 inserted into the substrate 300, and is spaced apart from the portion of the third conductive part 130, for example, via a space. Therefore, a capacitance can be formed between the third conductive part 130 and the first fixed pattern 322. Further, the resonance frequency of the first element 100 can be adjusted, by adjusting the capacitance according to the distance between the third conductive part 130 and the first fixed pattern 322.

The different second conductive parts 220 are inserted into the two respective third holes 330. That is, the second conductive part 220*a* and the second conductive part 220*b* are inserted into the third hole 330*a* and the third hole 330*b*, respectively. The second conductive part 220*a* inserted into the third hole 330*a* is electrically connected to the second hybrid circuit 350*b* via the wiring 352*c*. The second conductive part 220*b* inserted into the third hole 330*b* is electrically connected to the second hybrid circuit 350*b* via the wiring 352*d*. The second hybrid circuit 350*b* is electrically connected to the diplexer 360 via the wiring 362*b*.

The different fourth conductive parts 230 are inserted into the four respective fourth holes 340. That is, the fourth conductive part 230*a*, the fourth conductive part 230*b*, the fourth conductive part 230*c*, and the fourth conductive part 230*d* are inserted into the fourth hole 340*a*, the fourth hole 340*b*, the fourth hole 340*c*, and the fourth hole 340*d*, respectively. At the second surface 304 side of the substrate 300, each of the fourth holes 340 is surrounded by a second fixed pattern 342. It should be noted that a part of each of the fourth holes 340 may not be surrounded by the second fixed pattern 342. The second fixed pattern 342 is provided to fix the fourth conductive part 230 to the substrate 300. The fourth conductive part 230 is fixed to the substrate 300 by, for example, soldering the portion of the fourth conductive part 230 inserted into the substrate 300 and the second fixed pattern 342. The second fixed pattern 342 surrounds the portion of the fourth conductive part 230 inserted into the substrate 300, and is spaced apart from the portion of the fourth conductive part 230, for example, via a space. Therefore, a capacitance can be formed between the fourth conductive part 230 and the second fixed pattern 342. Further, the resonance frequency of the second element 200 can be adjusted, by adjusting the capacitance according to the distance between the fourth conductive part 230 and the second fixed pattern 342.

The first fixed pattern 322 is disposed such that an effective capacitance is formed not only between the first conductive part 120 and the first fixed pattern 322 but also between the first conductive plate 110 and the first fixed pattern 322. For example, a capacitance between the first conductive plate 110 and the first fixed pattern 322 can be increased, by increasing the area of the first fixed pattern 322 such that the area of the region where the first conductive plate 110 and the first fixed pattern 322 overlap is increased. Thus, the resonance frequency of the first element 100 can be lowered. Further, the second fixed pattern 342 is disposed such that an effective capacitance is formed between the second conductive plate 210 and the second fixed pattern 342. Similarly, a capacitance between the second conductive plate 210 and the second fixed pattern 342 can be increased, by increasing the area of the second fixed pattern 342 such that the area of the region where the second conductive plate 210 and the second fixed pattern 342 overlap is increased. Thus, the resonance frequency of the second element 200 can be lowered.

Figure 6:
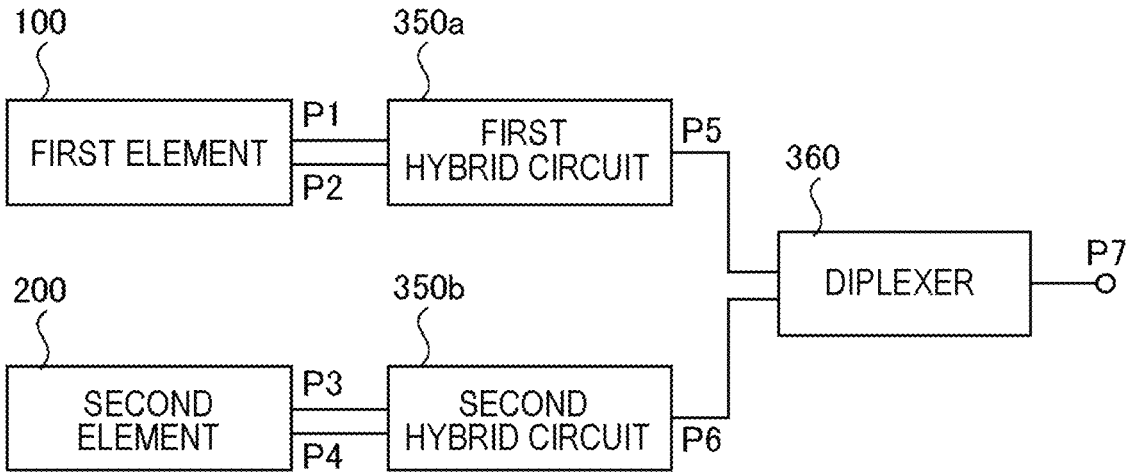
FIG. 6 is a block diagram showing a part of the antenna device shown in FIG. 1.

FIG. 6 is a block diagram showing the antenna device 10 shown in FIG. 1. An example of the operation of the antenna device 10 will be described with reference to FIGS. 1 to 5 and FIG. 6.

When the antenna device 10 receives radio waves, the first hybrid circuit 350*a* shifts the phase of the signal output from the first conductive part 120*a* of the first element 100 (the signal passing through the observation point P1 described later) and the phase of the signal output from the first conductive part 120*b* of the first element 100 (the signal passing through the observation point P2 described later) by 90° from each other. Then, the first hybrid circuit 350*a* outputs a combination signal (a signal passing through the observation point P5 described later) generated by combining these signals 90° out of phase with each other to the diplexer 360. On the other hand, the second hybrid circuit 350*b* shifts the phase of the signal output from the second conductive part 220*a* of the second element 200 (the signal passing through the observation point P3 described later) and the phase of the signal output from the second conductive part 220*b* of the second element 200 (the signal passing through the observation point P4 described later) by 90° from each other. Then, the second hybrid circuit 350*b* outputs a combination signal (a signal passing through the observation point P6 described later) generated by combining these signals 90° out of phase with each other to the diplexer 360. The diplexer 360 outputs a signal (a signal passing through the observation point P7 described later) generated by combining the combination signal output from the first hybrid circuit 350*a* (the signal passing through the observation point P5 described later) and the combination signal output from the second hybrid circuit 350*b* (the signal passing through the observation point P6 described later).

When the antenna device 10 transmits radio waves, the diplexer 360 separates the signal input to the diplexer 360 (the signal input through the observation point P7 described later) into two signals (the signal passing through the observation point P5 and the signal passing through the observation point P6 described later). Then, the diplexer 360 outputs one and the other of the two separated signals to the first hybrid circuit 350*a* and the second hybrid circuit 350*b*, respectively. The first hybrid circuit 350*a* divides the signal output from the diplexer 360 (the signal passing through the observation point P5 described later) into two signals (the signal passing through the observation point P1 and the signal passing through the observation point P2 described later), and shifts the phases of the two signals by 90° from each other. Then, the first hybrid circuit 350*a* outputs one and the other of these two signals 90° out of phase with each other, to the first conductive part 120*a* and the first conductive part 120*b* of the first element 100, respectively. Then, the first conductive plate 110 transmits circularly polarized radio waves. On the other hand, the second hybrid circuit 350*b* divides the signal output from the diplexer 360 (the signal passing through the observation point P6 described later) into two signals (the signal passing through the observation point P3 and the signal passing through the observation point P4 described later), and shifts the phases of the two signals by 90° from each other. Then, the second hybrid circuit 350*b* outputs one and the other of these two signals 90° out of phase with each other, to the second conductive part 220*a* and the second conductive part 220*b* of the second element 200, respectively. Then, the second conductive plate 210 transmits circularly polarized radio waves.

Next, simulation results of various characteristics of the antenna device 10 according to the embodiment will be described with reference to FIGS. 7 to 15. In FIGS. 7 to 15, the size of the first element 100 is 45 mm×45 mm×8 mm, and the size of the second element 200 is 25 mm×25 mm×9 mm. That is, the height (9 mm) of the second element 200 is higher than the height (8 mm) of the first element 100. The height of the first element 100 is the shortest distance from the first surface 302 of the substrate 300 to the first conductive plate 110 of the first element 100 in the direction perpendicular to the first surface 302 of the substrate 300. The height of the second element 200 is the shortest distance from the first surface 302 of the substrate 300 to the second conductive plate 210 of the second element 200 in the direction perpendicular to the first surface 302 of the substrate 300. In FIGS. 7 to 15, the first element 100 operates as an antenna in the GPS frequency band, and the second element 200 operates as an antenna in the SXM frequency band.

Figure 7:
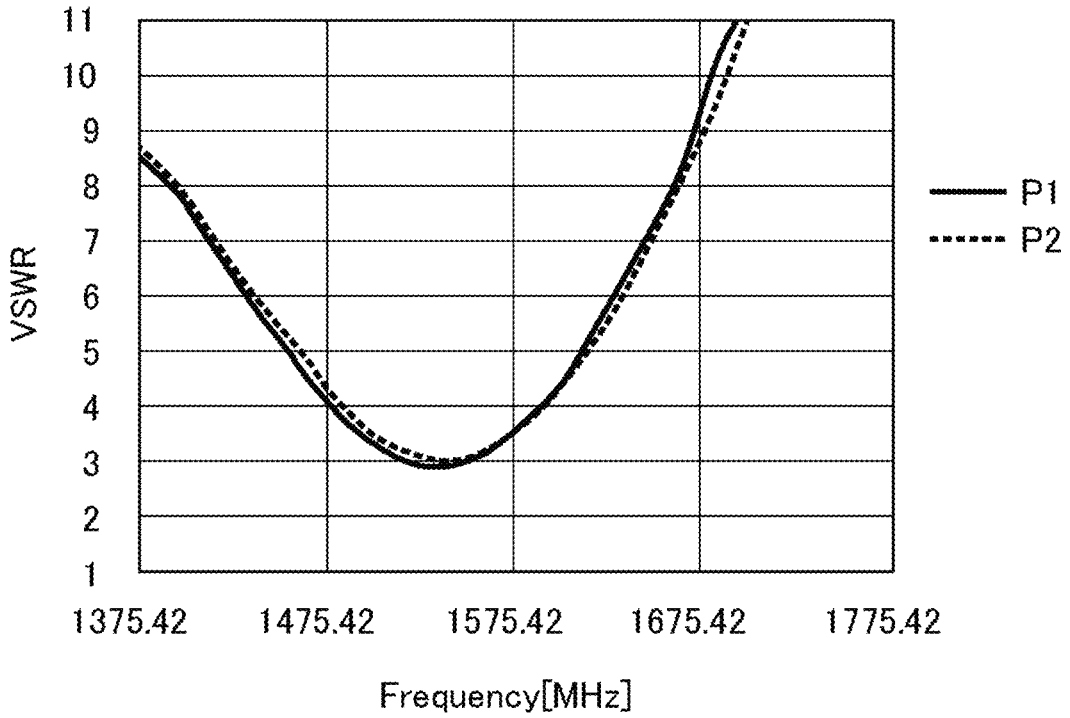
FIG. 7 is a graph showing an example of the frequency characteristics of a Voltage Standing Wave Ratio (VSWR) at each of a first feeding part (observation point P1 in FIG. 6) and a second feeding part (observation point P2 in FIG. 6) of a first element.

FIG. 7 is a graph showing an example of the frequency characteristics of a Voltage Standing Wave Ratio (VSWR) at each of a first feeding part (the observation point P1 in FIG. 6 and the first conductive part 120*a* in FIG. 1) and a second feeding part (the observation point P2 in FIG. 6 and the first conductive part 120*b* in FIG. 1) of the first element 100. The VSWR at the observation point P1 and the observation point P2 is approximately 3 around the frequency 1525 MHz.

Figure 8:
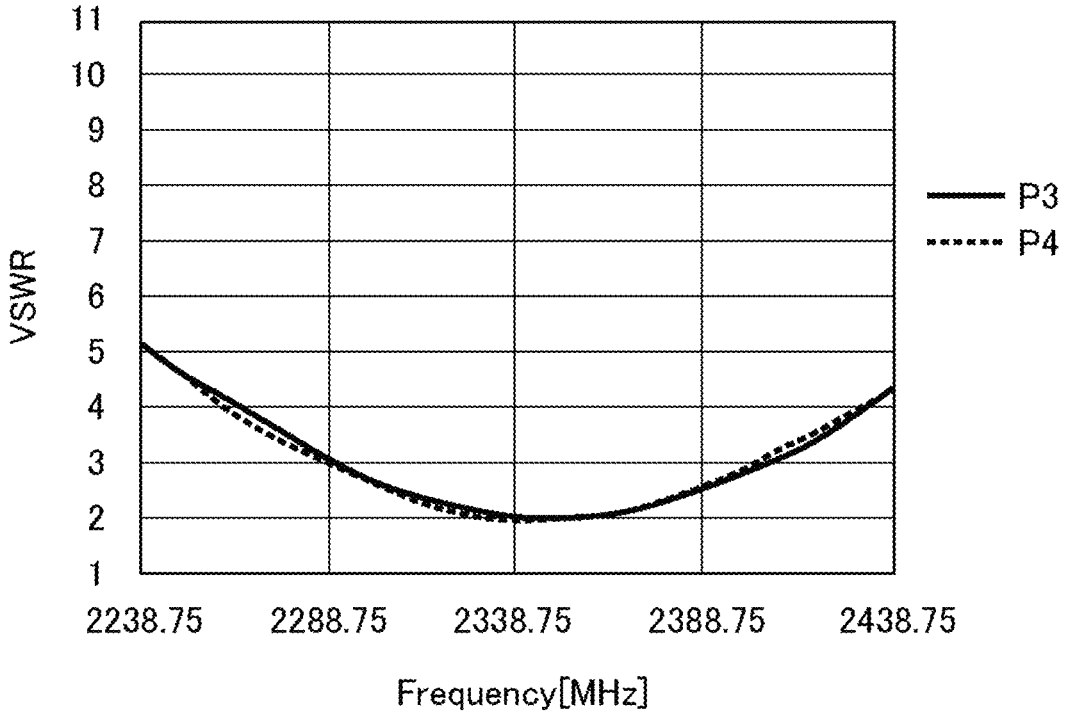
FIG. 8 is a graph showing an example of the frequency characteristics of VSWR at each of a first feeding part (observation point P3 in FIG. 6) and a second feeding part (observation point P4 in FIG. 6) of a second element.

FIG. 8 is a graph showing an example of the frequency characteristics of a VSWR at each of a first feeding part (the observation point P3 in FIG. 6 and the second conductive part 220*a* in FIG. 1) and a second feeding part (the observation point P4 in FIG. 6 and the second conductive part 220*b* in FIG. 1) of the second element 200. The VSWR at the observation point P3 and the observation point P4 is approximately 2 around the frequency 2340 MHz.

Figure 9:
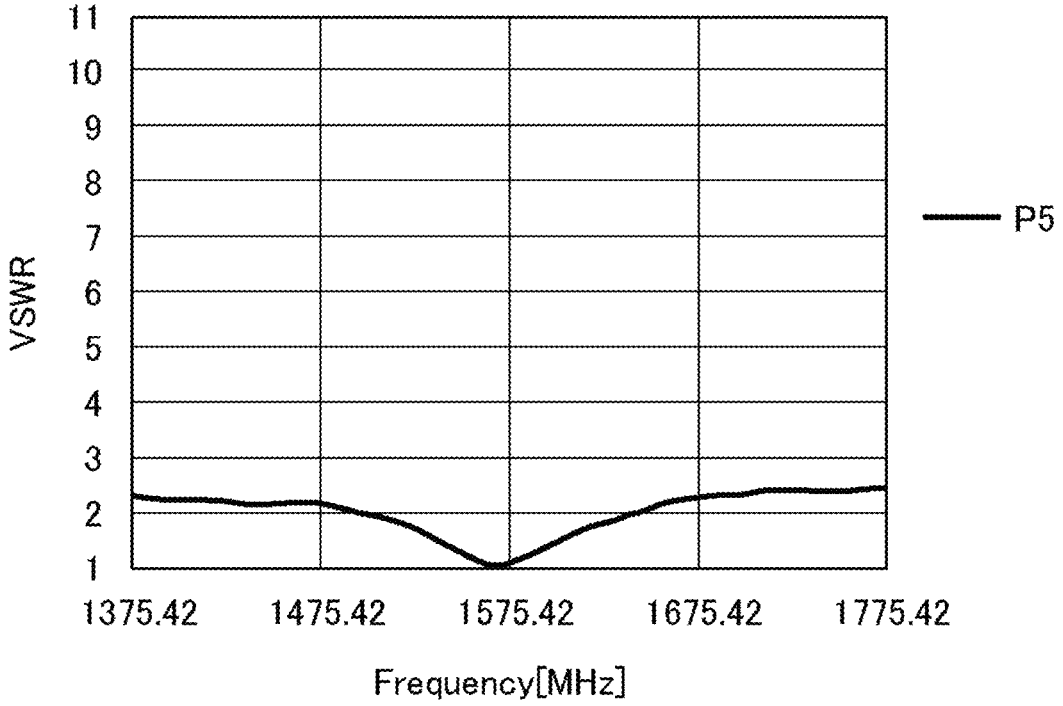
FIG. 9 is a graph showing an example of the frequency characteristics of VSWR at a portion (observation point P5 in FIG. 6) of a first hybrid circuit connected to a diplexer.

FIG. 9 is a graph showing an example of the frequency characteristics of VSWR at a portion (the observation point P5 in FIG. 6) of the first hybrid circuit 350*a* connected to the diplexer 360. The VSWR at the observation point P5 is less than 3 from the frequency 1375.42 MHz to the frequency 1775.42 MHz.

Figure 10:
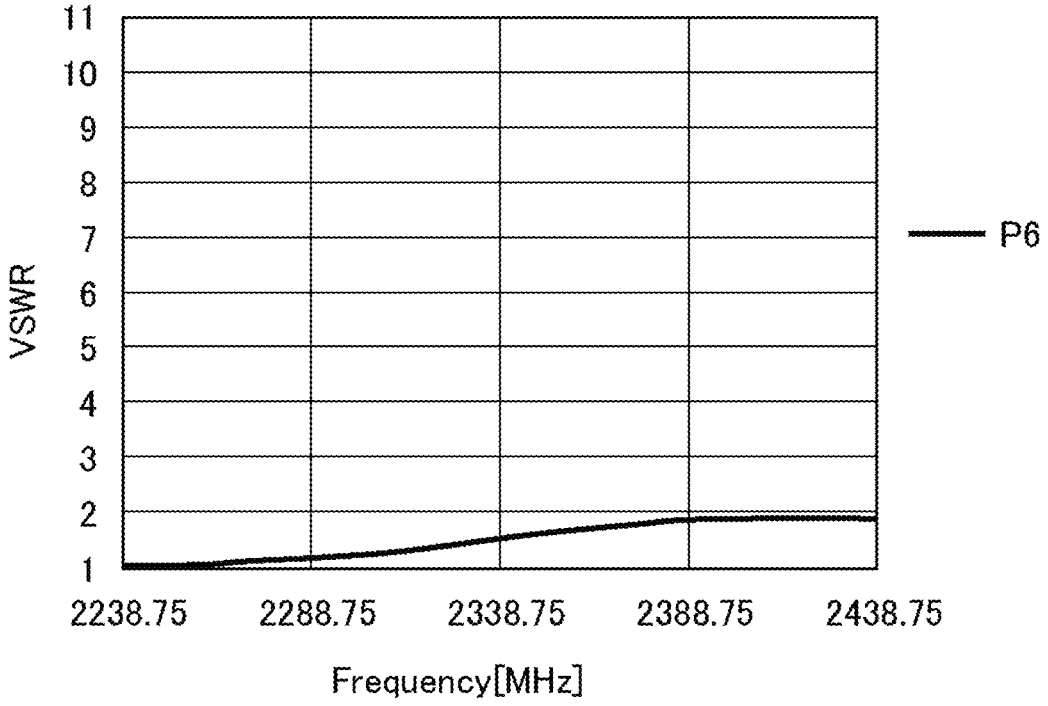
FIG. 10 is a graph showing an example of the frequency characteristics of VSWR at a portion (observation point P6 in FIG. 6) of a second hybrid circuit connected to the diplexer.

FIG. 10 is a graph showing an example of the frequency characteristics of VSWR at a portion (the observation point P6 in FIG. 6) of the second hybrid circuit 350*b* connected to the diplexer 360. The VSWR at the observation point P6 is less than 2 from the frequency 2238.75 MHz to the frequency 2438.75 MHz.

Figure 11:
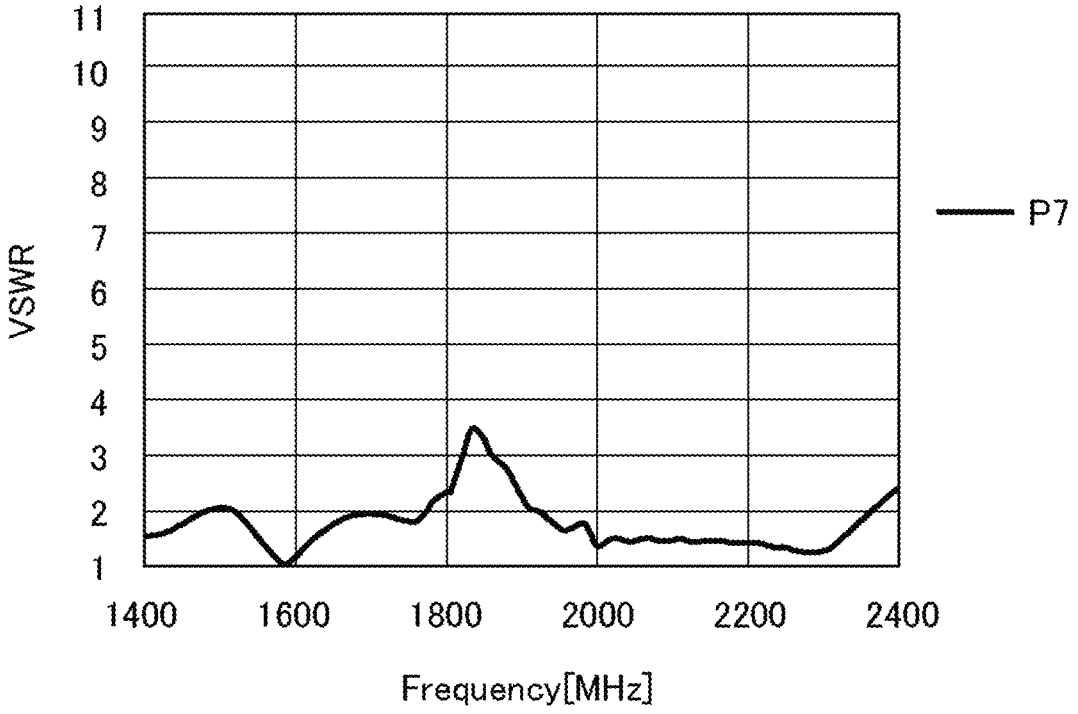
FIG. 11 is a graph showing an example of the frequency characteristics of VSWR at an input and output unit (observation point P7 in FIG. 6) of the diplexer.

FIG. 11 is a graph showing an example of the frequency characteristics of VSWR at an input and output unit (the observation point P7 in FIG. 6) of the diplexer 360. The VSWR at the observation point P7 is less than 3 from the frequency 1400 MHz to the frequency 2400 MHz except for the frequency around 1850 MHz.

Figure 12:
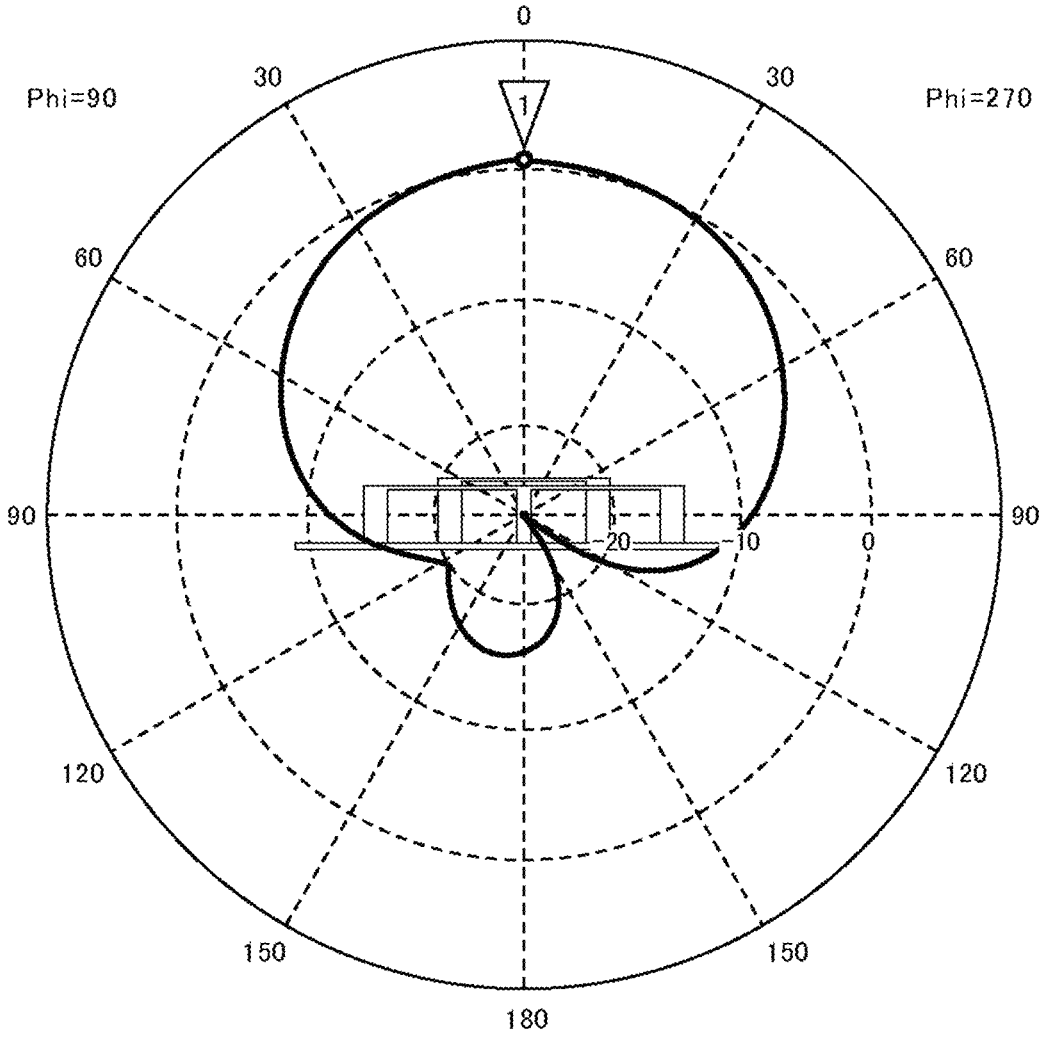
FIG. 12 is a diagram showing an example of directivity characteristics of the gain (dBi) of the first element.

FIG. 12 is a diagram showing an example of the directivity characteristics of the gain (dBi) of the first element 100. The gain of the first element 100 is 0.6 dBi at the boresight (where 1 is described inside the inverted triangle in FIG. 12).

Figure 13:
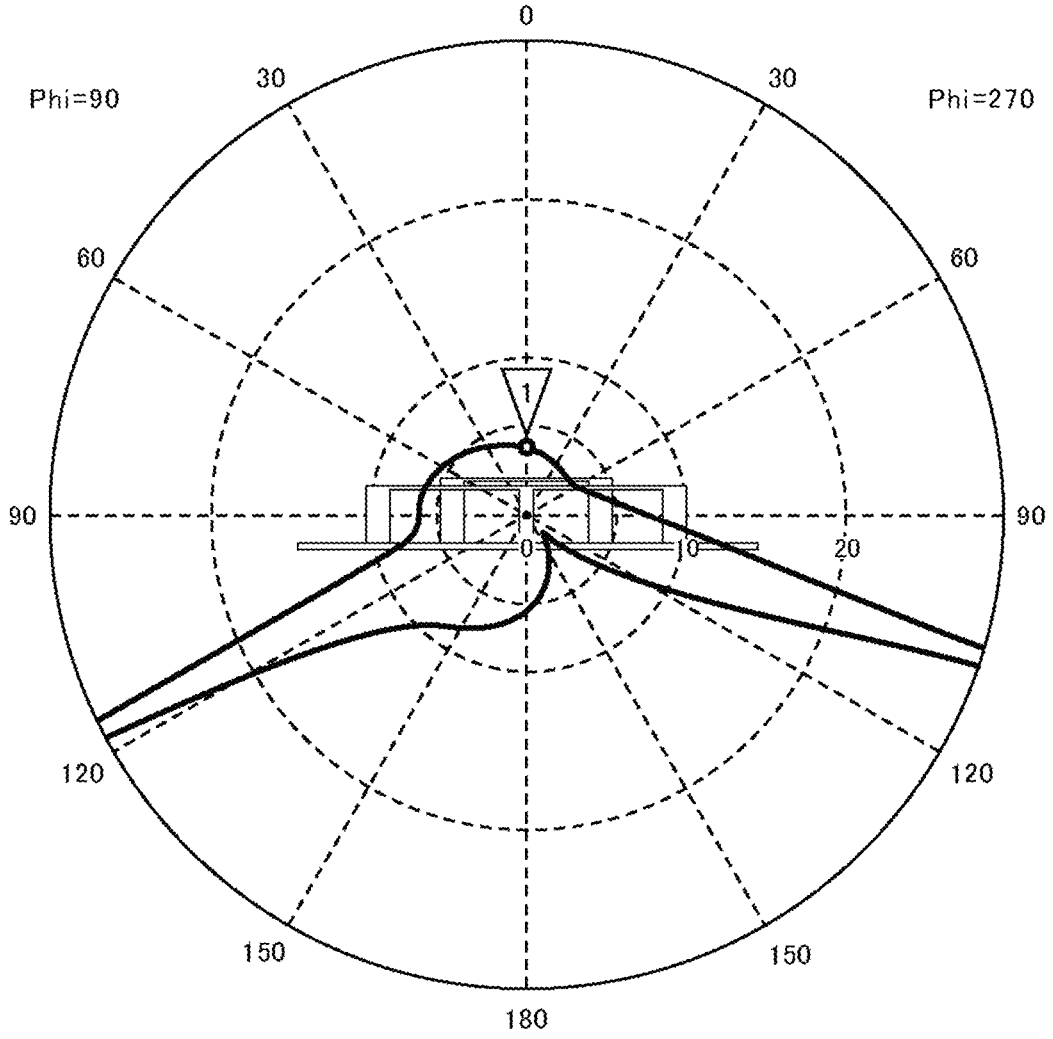
FIG. 13 is a diagram showing an example of directivity characteristics of the axial ratio (dB) of the first element.

FIG. 13 is a diagram showing an example of the directivity characteristics of the axial ratio (dB) of the first element 100. The axial ratio of the first element 100 is 4.3 dB at the boresight (where 1 is described inside the inverted triangle in FIG. 13).

Figure 14:
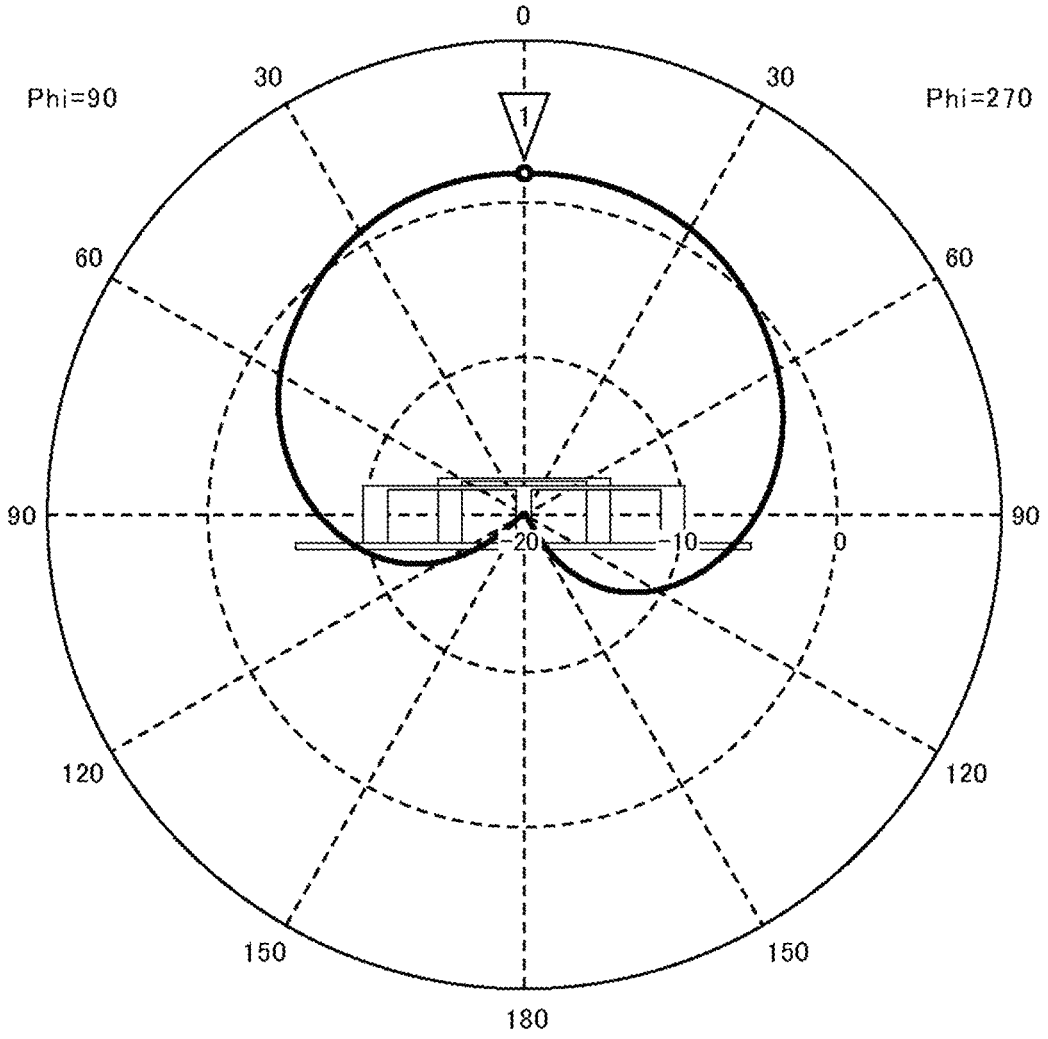
FIG. 14 is a diagram showing an example of directivity characteristics of the gain (dBi) of the second element.

FIG. 14 is a diagram showing an example of the directivity characteristics of the gain (dBi) of the second element 200. The gain of the second element 200 is 1.8 dBi at the boresight (where 1 is described inside the inverted triangle in FIG. 14).

Figure 15:
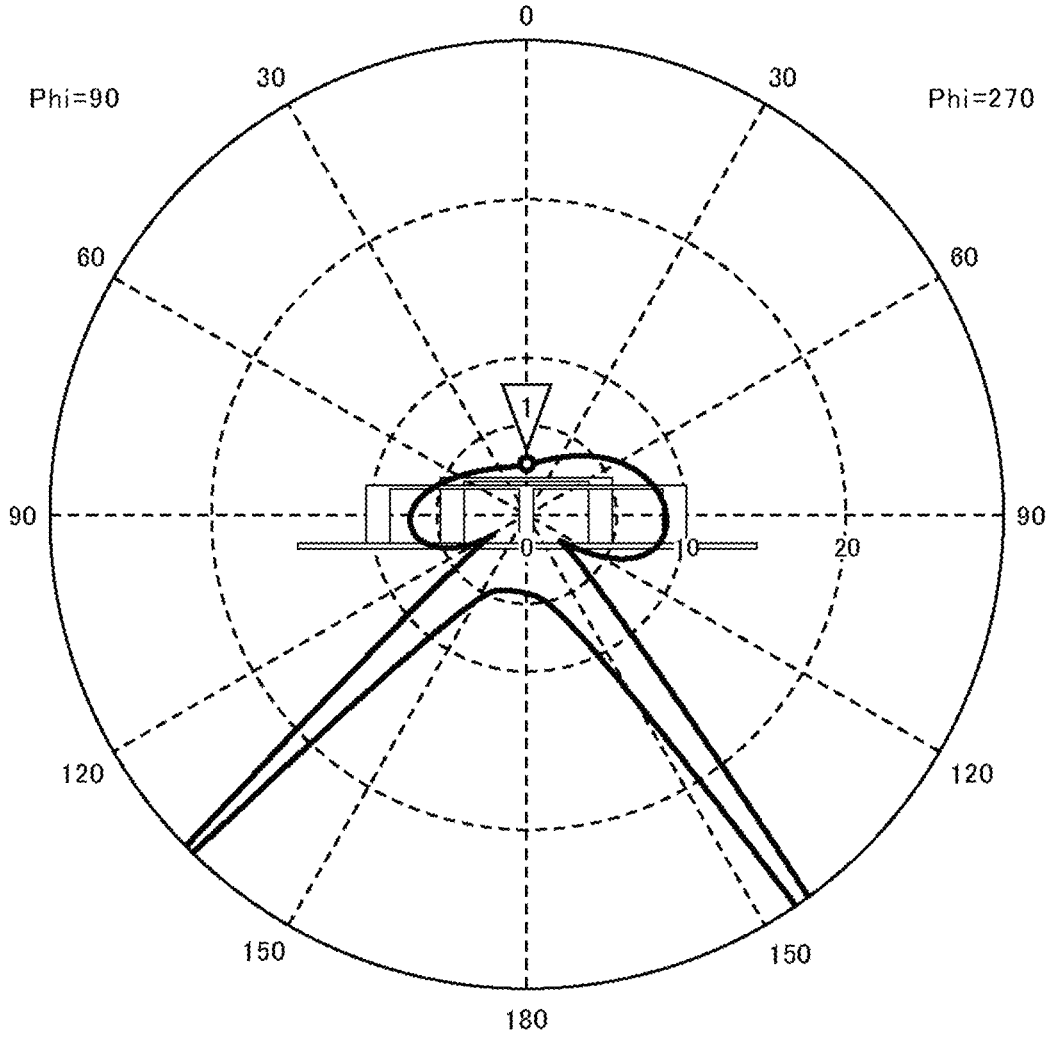
FIG. 15 is a diagram showing an example of directivity characteristics of the axial ratio (dB) of the second element.

FIG. 15 is a diagram showing an example of the directivity characteristics of the axial ratio (dB) of the second element 200. The axial ratio of the second element 200 is 3.1 dB at the boresight (where 1 is described inside the inverted triangle in FIG. 15).

Next, using the simulation results of FIG. 16, the influence that the relationship between the height of the first element 100 and the height of the second element 200 can have on the characteristics of the antenna device 10 will be described.

Figure 16:
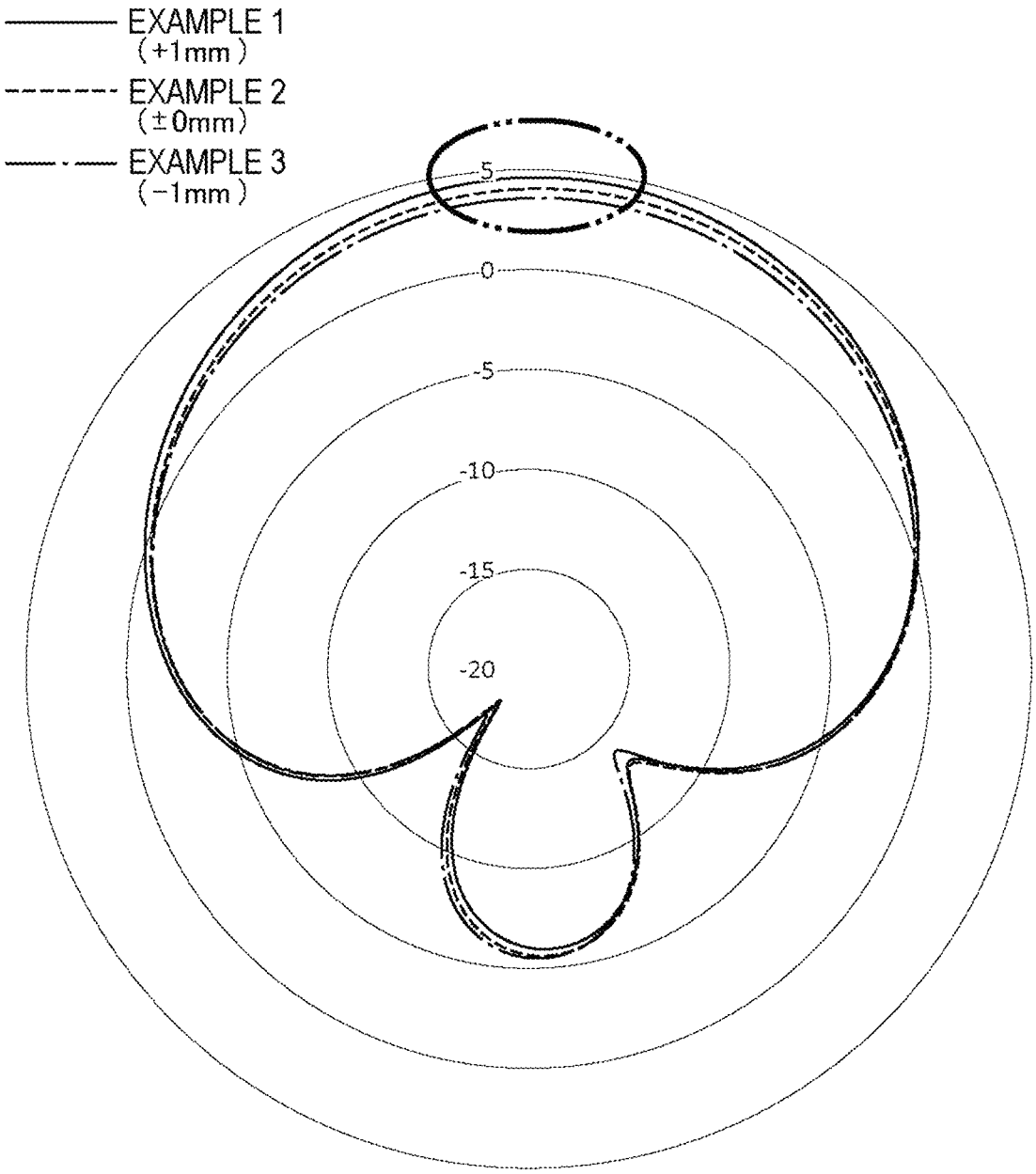
FIG. 16 is a graph showing an example of a relationship between the respective heights of the first element and the second element and the directivity characteristics of the gain of the second element.

FIG. 16 is a graph showing an example of a relationship between the respective heights of the first element 100 and the second element 200 and the directivity characteristics of the gain of the second element 200. The antenna devices 10 in Examples 1 to 3 in FIG. 16 are adjusted such that the VSWRs are almost the same. The direction from the lower side to the upper side of FIG. 16 is the direction from the first surface 302 of the substrate 300 toward the second conductive plate 210 of the second element 200.

In Example 1 in FIG. 16, the height of the second element 200 is higher than the height of the first element 100 by 1 mm. That is, in the direction perpendicular to the first surface 302 of the substrate 300, the shortest distance from the first surface 302 of the substrate 300 to the second conductive plate 210 of the second element 200 is longer than the shortest distance from the first surface 302 of the substrate 300 to the first conductive plate 110 of the first element 100.

In Example 2 in FIG. 16, the height of the second element 200 is equal to the height of the first element 100. That is, in the direction perpendicular to the first surface 302 of the substrate 300, the shortest distance from the first surface 302 of the substrate 300 to the second conductive plate 210 of the second element 200 is equal to the shortest distance from the first surface 302 of the substrate 300 to the first conductive plate 110 of the first element 100.

In Example 3 in FIG. 16, the height of the second element 200 is lower than the height of the first element 100 by 1 mm. That is, in the direction perpendicular to the first surface 302 of the substrate 300, the shortest distance from the first surface 302 of the substrate 300 to the second conductive plate 210 of the second element 200 is shorter than the shortest distance from the first surface 302 of the substrate 300 to the first conductive plate 110 of the first element 100.

In the region surrounded by the dash-double-dot line in FIG. 16, the gain increases in the order of Example 3, Example 2, and Example 1. From this result, the higher height of the second conductive plate 210 with respect to the first conductive plate 110 would provide higher radiation efficiency.

Figure 17:
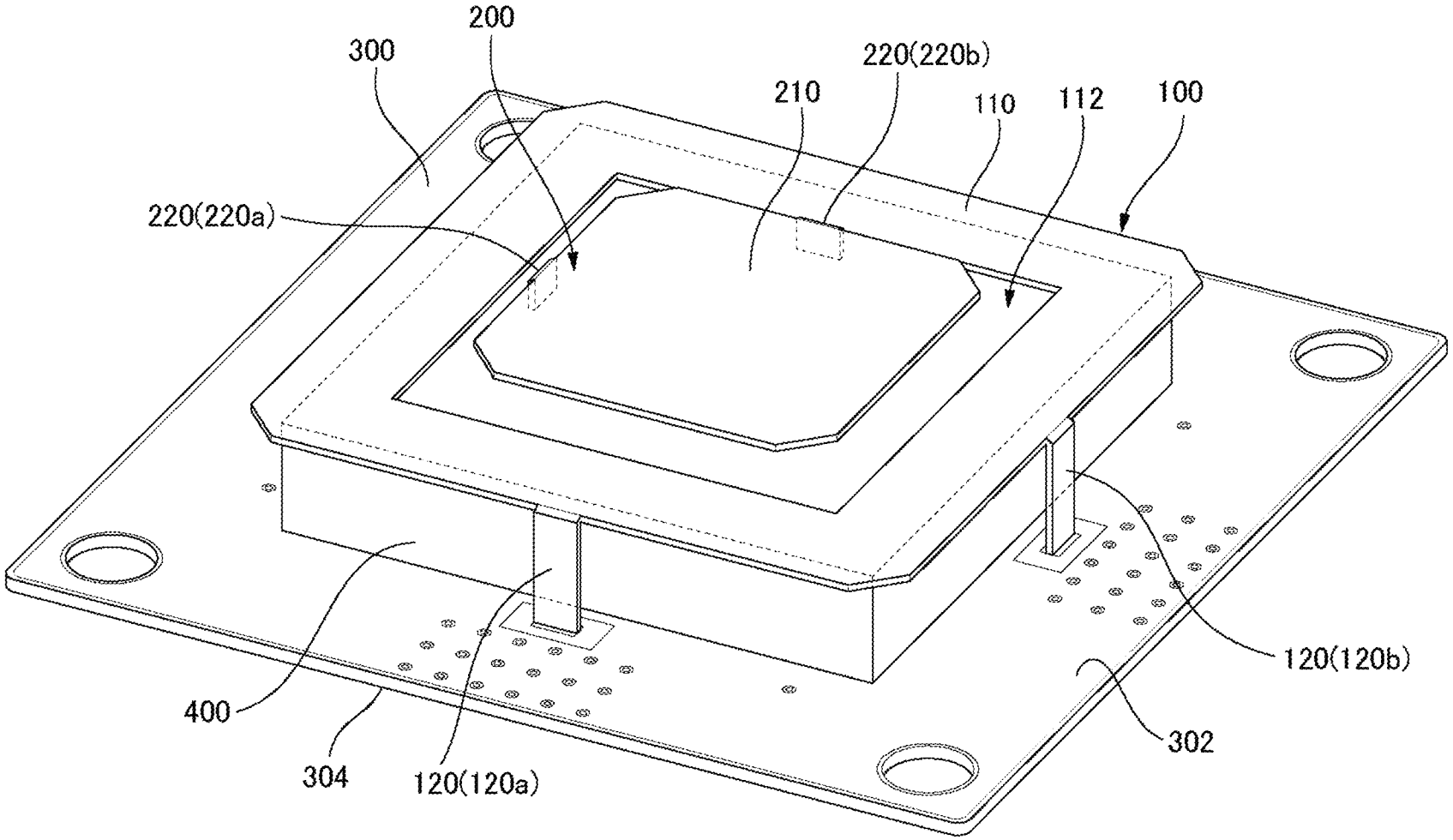
FIG. 17 is a perspective view showing an antenna device according to a first modification example.

FIG. 17 is a perspective view showing the antenna device 10 according to a first modification example. The antenna device 10 according to the present modification example is the same as the antenna device 10 according to the embodiment, except for the following points.

The antenna device 10 further includes a dielectric 400. The dielectric 400 is located both between the first conductive plate 110 and the substrate 300 and between the second conductive plate 210 and the substrate 300. In other words, the dielectric 400 extends from the region overlapping the second conductive plate 210 to the region overlapping the first conductive plate 110. The dielectric 400 can increase the capacitance between the first conductive plate 110 and the substrate 300, and as compared to the case where the antenna device 10 does not include the dielectric 400, the size of the first conductive plate 110 can be reduced while maintaining the performance of the first element 100. Similarly, the dielectric 400 can increase the capacitance between the second conductive plate 210 and the substrate 300, and as compared to the case where the antenna device 10 does not include the dielectric 400, the size of the second conductive plate 210 can be reduced while maintaining the performance of the second element 200.

The dielectric 400 may be solid or hollow. The dielectric 400 may be a dielectric member attached to the substrate 300, the first conductive plate 110 or the second conductive plate 210, or may be a dielectric layer deposited on the substrate 300. When the dielectric 400 is a dielectric layer, the first conductive plate 110 and the second conductive plate 210 may be formed by patterning on the dielectric layer (dielectric 400). In the example shown in FIG. 17, each of the first conductive parts 120 of the first element 100 is located outside the dielectric 400, and each of the second conductive parts 220 of the second element 200 is inserted into the hole formed on the dielectric 400. By inserting the second conductive part 220 into the dielectric 400, the second conductive part 220 can be supported by the dielectric 400. However, each of the first conductive parts 120 of the first element 100 may also be inserted into the hole formed in the dielectric 400. By inserting the first conductive part 120 into the dielectric 400, the first conductive part 120 can be supported by the dielectric 400.

The height (thickness) of the dielectric 400 can be changed according to the capacitance between the first conductive plate 110 and the substrate 300 and the capacitance between the second conductive plate 210 and the substrate 300. In the direction perpendicular to the first surface 302 of the substrate 300, the dielectric 400 may be located, for example, over the entire region between the first conductive plate 110 and the substrate 300, or may be located only in a part of the region between the first conductive plate 110 and the substrate 300. Alternatively, the dielectric 400 may be located, for example, over the entire region between the second conductive plate 210 and the substrate 300, or may be located only in a part of the region between the second conductive plate 210 and the substrate 300.

In the present modification example, the first element 100 does not have the third conductive part 130 shown in FIG. 1. Even if the first element 100 does not have the third conductive part 130, the first conductive plate 110 can be located away from the first surface 302 of the substrate 300 by mounting the first conductive plate 110 on the dielectric 400. However, the first element 100 may have the third conductive part 130. In this case, the third conductive part 130 may be located outside the dielectric 400, or may be inserted into a hole formed in the dielectric 400. Similarly, in the present modification example, the second element 200 does not have the fourth conductive part 230 shown in FIG. 1. However, the second element 200 may have the fourth conductive part 230. In this case, the fourth conductive part 230 may be inserted into the hole formed in the dielectric 400.

Figure 18:
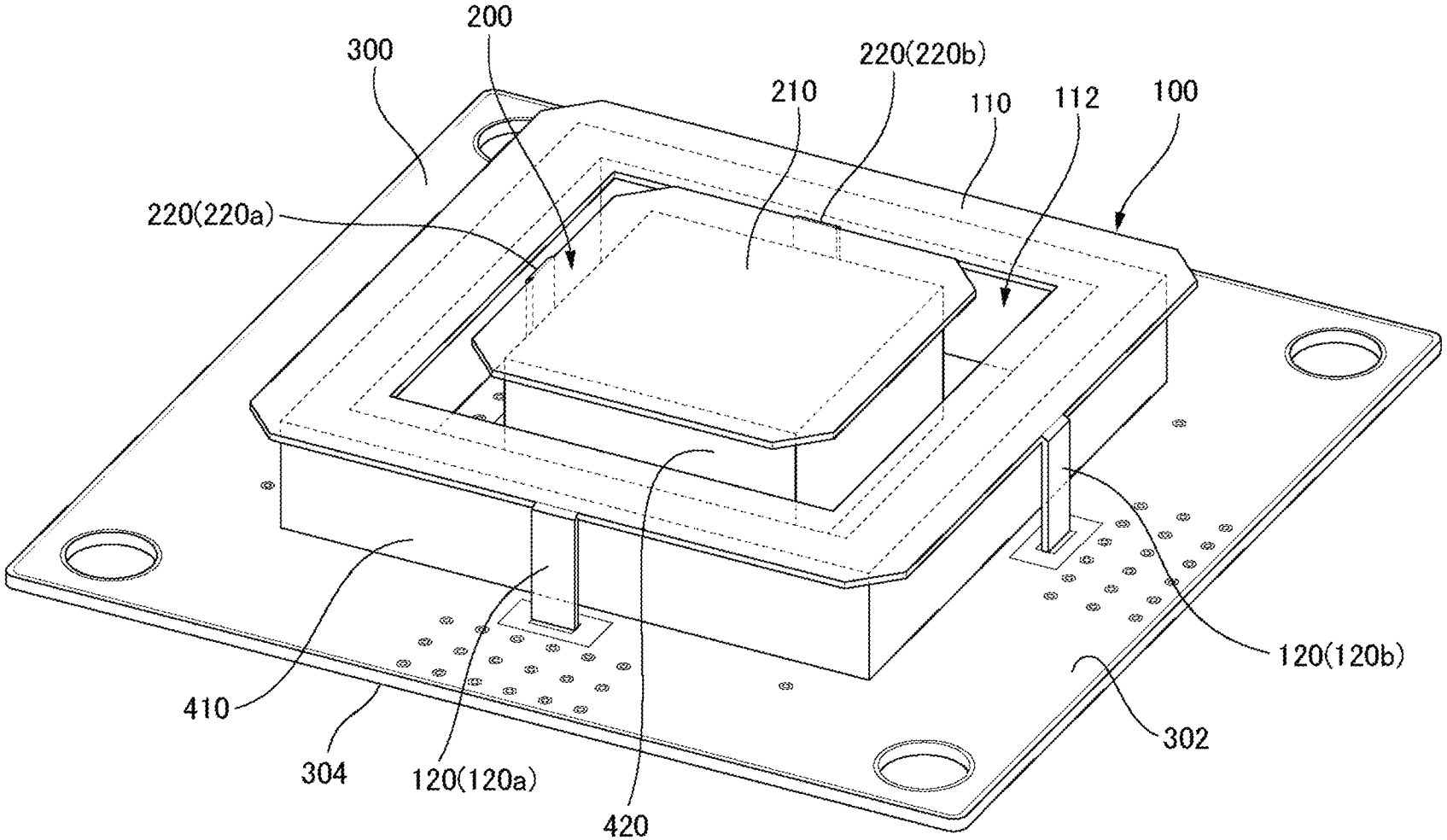
FIG. 18 is a perspective view showing an antenna device according to a second modification example.

FIG. 18 is a perspective view showing an antenna device 10 according to a second modification example. The antenna device 10 according to the present modification example is the same as the antenna device 10 according to the embodiment, except for the following points.

The antenna device 10 further includes a first dielectric 410 and a second dielectric 420. The first dielectric 410 is located between the first conductive plate 110 and the substrate 300. The second dielectric 420 is located between the second conductive plate 210 and the substrate 300. The first dielectric 410 and the second dielectric 420 are spaced apart from each other. The first dielectric 410 can increase the capacitance between the first conductive plate 110 and the substrate 300, and as compared to the case where the antenna device 10 does not include the first dielectric 410, the size of the first conductive plate 110 can be reduced while maintaining the performance of the first element 100. Similarly, the second dielectric 420 can increase the capacitance between the second conductive plate 210 and the substrate 300, and as compared to the case where the antenna device 10 does not include the second dielectric 420, the size of the second conductive plate 210 can be reduced while maintaining the performance of the second element 200. Further, since the first dielectric 410 and the second dielectric 420 are spaced apart from each other, as compared with the case where the first dielectric 410 and the second dielectric 420 are connected to each other as shown in FIG. 17, it is easy to individually adjust the capacitance between the first conductive plate 110 and the substrate 300 and the capacitance between the second conductive plate 210 and the substrate 300.

Each of the first dielectric 410 and the second dielectric 420 may be solid or hollow. The first dielectric 410 may be a dielectric member attached to the substrate 300 or the first conductive plate 110, or may be a dielectric layer deposited on the substrate 300. When the first dielectric 410 is a dielectric layer, the first conductive plate 110 may be formed by patterning on the dielectric layer (first dielectric 410). In the example shown in FIG. 18, each of the first conductive parts 120 is located outside the first dielectric 410. However, each of the first conductive parts 120 may be inserted into a hole formed in the first dielectric 410. In this case, the first conductive part 120 can be supported by the first dielectric 410. For the second dielectric 420, the same aspect as the aspect of the first dielectric 410 can be adopted.

The height (thickness) of the first dielectric 410 can be changed according to the capacitance between the first conductive plate 110 and the substrate 300. In the direction perpendicular to the first surface 302 of the substrate 300, the first dielectric 410 may be located over the entire region between the first conductive plate 110 and the substrate 300, or may be located only in a part of the region between the first element 100 and the substrate 300. The height (thickness) of the second dielectric 420 can be determined in the same manner.

In the present modification example, the dielectric is located between the first conductive plate 110 and the substrate 300 and between the second conductive plate 210 and the substrate 300. However, the dielectric may be located only either between the first conductive plate 110 and the substrate 300 or between the second conductive plate 210 and the substrate 300. That is, the dielectric may be located at least one of between the first conductive plate 110 and the substrate 300 and between the second conductive plate 210 and the substrate 300.

In the present modification example, the first element 100 does not have the third conductive part 130 shown in FIG. 1. Even if the first element 100 does not have the third conductive part 130, the first conductive plate 110 can be located away from the first surface 302 of the substrate 300 by mounting the first conductive plate 110 on the first dielectric 410. However, the first element 100 may have the third conductive part 130. In this case, the third conductive part 130 may be located outside the first dielectric 410, or may be inserted into a hole formed in the first dielectric 410. Similarly, in the present modification example, the second element 200 does not have the fourth conductive part 230 shown in FIG. 1. However, the second element 200 may have the fourth conductive part 230 shown in FIG. 1. In this case, the fourth conductive part 230 may be located outside the second dielectric 420, or may be inserted into a hole formed in the second dielectric 420.

Although the embodiment and modification examples of the present invention have been described above with reference to the drawings, these are examples of the present invention, and various configurations other than the above can be adopted.

This application claims priority based on Japanese Patent Application No. 2019-137639 filed on Jul. 26, 2019, the content of which is incorporated herein in its entirety.

REFERENCE SIGNS LIST

10: antenna device
100: first element
110: first conductive plate
112: opening
120: first conductive part
120*a*: first conductive part
120*b*: first conductive part
130: third conductive part
130*a*: third conductive part
130*b*: third conductive part
130*c*: third conductive part
130*d*: third conductive part
200: second element
210: second conductive plate
220: second conductive part
220*a*: second conductive part
220*b*: second conductive part
230: fourth conductive part
230*a*: fourth conductive part
230*b*: fourth conductive part
230*c*: fourth conductive part
230*d*: fourth conductive part
300: substrate
302: first surface
304: second surface
310: first hole
310*a*: first hole
310*b*: first hole
320: second hole
320*a*: second hole
320*b*: second hole
320*c*: second hole
320*d*: second hole
322: first fixed pattern
330: third hole
330*a*: third hole
330*b*: third hole
340: fourth hole
340*a*: fourth hole
340*b*: fourth hole
340*c*: fourth hole
340*d*: fourth hole
342: second fixed pattern
350*a*: first hybrid circuit
350*b*: second hybrid circuit
352*a*: wiring
352*b*: wiring
352*c*: wiring
352*d*: wiring
360: diplexer
362*a*: wiring
362*b*: wiring
400: dielectric
410: first dielectric
420: second dielectric

The invention claimed is:

1. An antenna device comprising:

a substrate comprising a first surface;

a first element comprising a first conductive plate and a first conductive part, the first conductive plate being located at the first surface side of the substrate away from the first surface of the substrate, the first conductive plate comprising an opening, the first conductive part electrically connecting the first conductive plate and the substrate to each other; and a second element comprising a second conductive plate and a second conductive part, the second conductive plate being located at the first surface side of the substrate away from the first surface of the substrate, the second conductive part electrically connecting the second conductive plate and the substrate to each other, wherein the second conductive plate is located inside the opening of the first conductive plate, and wherein the first conductive part and the second conductive part are located opposite to each other across a center of the first conductive plate or the second conductive plate.

2. The antenna device according to claim 1, wherein a distance from the first surface of the substrate to the second conductive plate of the second element is equal to or greater than a distance from the first surface of the substrate to the first conductive plate of the first element.

3. The antenna device according to claim 1, wherein the first element comprises a plurality of the first conductive parts, and the second element comprises a plurality of the second conductive parts.

4. The antenna device according to claim 1, wherein the first element comprises at least two first conductive parts located around a center of the first conductive plate at intervals of 90°, and a third conductive part located between the two first conductive parts around the center of the first conductive plate, the second element comprises at least two second conductive parts located around a center of the second conductive plate at intervals of 90°, and a fourth conductive part located between the two second conductive parts around the center of the second conductive plate, and the third conductive part and the fourth conductive part are located opposite to each other across the center of the first conductive plate or the second conductive plate.

5. The antenna device according to claim 1, wherein a portion of the first element from the first conductive plate to the first conductive part is bent from a direction along the first surface of the substrate to a direction toward the first surface, and a portion of the second element from the second conductive plate to the second conductive part is bent from a direction along the first surface of the substrate to the direction toward the first surface.

6. The antenna device according to claim 1, further comprising:

a dielectric located at least one of between the first conductive plate and the substrate and between the second conductive plate and the substrate.

7. The antenna device according to claim 1, wherein the first conductive plate of the first element comprises an inner edge defining the opening, and an outer edge located outside the inner edge, and the first conductive part is electrically connected to the outer edge of the first conductive plate.

8. The antenna device according to claim 1, wherein the first conductive plate of the first element comprises an inner edge defining the opening, and an outer edge located outside the inner edge, and the outer edge of the first conductive plate is linear.

9. The antenna device according to claim 1, wherein the first element functions as a GNSS band antenna, and the second element functions as an SXM band antenna.

10. An antenna device comprising:

a substrate comprising a first surface;

a first element comprising a first conductive plate and a first conductive part, the first conductive plate being located at the first surface side of the substrate away from the first surface of the substrate, the first conductive plate comprising an opening, the first conductive part electrically connecting the first conductive plate and the substrate to each other;

a second element comprising a second conductive plate and a second conductive part, the second conductive plate being located at the first surface side of the substrate away from the first surface of the substrate, the second conductive part electrically connecting the second conductive plate and the substrate to each other; and a dielectric located at least one of between the first conductive plate and the substrate and between the second conductive plate and the substrate, wherein the second conductive plate is located inside the opening of the first conductive plate.

11. The antenna device according to claim 10, wherein the first conductive plate of the first element comprises an inner edge defining the opening, and an outer edge located outside the inner edge, and wherein the first conductive part is electrically connected to the outer edge of the first conductive plate.

12. The antenna device according to claim 10, wherein the first conductive plate of the first element comprises an inner edge defining the opening, and an outer edge located outside the inner edge, and wherein the outer edge of the first conductive plate is linear.

13. The antenna device according to claim 10, wherein the first element functions as a GNSS band antenna, and the second element functions as an SXM band antenna.

14. An antenna device comprising:

a substrate comprising a first surface;

a first element comprising a first conductive plate and a first conductive part, the first conductive plate being located at the first surface side of the substrate away from the first surface of the substrate, the first conductive plate comprising an opening, the first conductive part electrically connecting the first conductive plate and the substrate to each other; and a second element comprising a second conductive plate and a second conductive part, the second conductive plate being located at the first surface side of the substrate away from the first surface of the substrate, the second conductive part electrically connecting the second conductive plate and the substrate to each other, wherein the second conductive plate is located inside the opening of the first conductive plate, wherein the first conductive plate of the first element comprises an inner edge defining the opening, and an outer edge located outside the inner edge, and wherein the outer edge of the first conductive plate is linear.

15. The antenna device according to claim 14, wherein the first element functions as a GNSS band antenna, and the second element functions as an SXM band antenna.

* * * * *